US007711293B2

(12) United States Patent
Koyama

(10) Patent No.: US 7,711,293 B2
(45) Date of Patent: May 4, 2010

(54) TONER CONTAINER

(75) Inventor: Kazuya Koyama, Ikoma (JP)

(73) Assignee: Sharp Kabushiki Kaisha, Osaka (JP)

( * ) Notice: Subject to any disclaimer, the term of this patent is extended or adjusted under 35 U.S.C. 154(b) by 442 days.

(21) Appl. No.: 11/700,897

(22) Filed: Feb. 1, 2007

(65) Prior Publication Data

US 2007/0206975 A1 Sep. 6, 2007

(30) Foreign Application Priority Data

Mar. 6, 2006 (JP) ..... 2006-059771

(51) Int. Cl.
*G03G 15/08* (2006.01)

(52) U.S. Cl. ..... 399/262; 399/258

(58) Field of Classification Search ..... 399/262, 399/222, 252, 258, 12, 27, 102, 103, 106; 215/316, 329, 330; 220/288, 293, 298
See application file for complete search history.

(56) References Cited

U.S. PATENT DOCUMENTS

| | | | | |
|---|---|---|---|---|
| 4,736,859 | A * | 4/1988 | Mayes et al. | 215/330 |
| 5,096,083 | A * | 3/1992 | Shaw et al. | |
| 5,685,445 | A | 11/1997 | Dobbs | |
| 5,848,516 | A * | 12/1998 | Ban | 53/453 |
| 5,983,059 | A | 11/1999 | Oka et al. | |
| 6,456,811 | B1 | 9/2002 | Kato | |
| 6,766,135 | B2 * | 7/2004 | Wang et al. | 399/262 |
| 2004/0091289 | A1 * | 5/2004 | Terazawa et al. | 399/258 |
| 2004/0247329 | A1 * | 12/2004 | Ito et al. | 399/12 |
| 2005/0123323 | A1 * | 6/2005 | Koyama et al. | 399/258 |
| 2005/0286914 | A1 * | 12/2005 | Nagahama | 399/12 |
| 2007/0140707 | A1 * | 6/2007 | Kaiho | 399/12 |
| 2007/0264032 | A1 * | 11/2007 | Harumoto | 399/12 |

FOREIGN PATENT DOCUMENTS

| | | |
|---|---|---|
| JP | 08-113254 | 5/1996 |
| JP | 9-2502 A | 1/1997 |
| JP | 09-288415 | 11/1997 |
| JP | 9-288415 A | 11/1997 |
| JP | 10-142936 | 5/1998 |
| JP | 2001-312129 | 11/2001 |
| JP | 2002-123074 | 4/2002 |
| JP | 2003-162143 | 6/2003 |
| JP | 2005-309166 | 11/2005 |

* cited by examiner

*Primary Examiner*—David P Porta
*Assistant Examiner*—Milton Gonzalez
(74) *Attorney, Agent, or Firm*—Nixon & Vanderhye, PC

(57) ABSTRACT

A toner bottle that is composed of a main part, a toner loading portion, a bottle cap that can hermetically close and open a toner loading opening in the toner loading portion, and a bottle-side toner discharge port. This toner bottle is constructed such that the bottle cap that encloses the toner loading opening has a locking projection which can limit the rotation in the loosening direction while the toner loading portion has a cap locking projection which will engage the locking projection and can limit the rotation in the loosening direction.

4 Claims, 28 Drawing Sheets

TONER CONTAINER

This Nonprovisional application claims priority under 35 U.S.C. §119(a) on Patent Application No. 2006-59771 filed in Japan on 6 Mar. 2006, the entire contents of which are hereby incorporated by reference.

BACKGROUND OF THE TECHNOLOGY

1. Field of the Technology

The present technology relates to a toner container and a toner loading method, in particular relating to a toner container and a method of loading toner into the toner container for use in an image forming apparatus that performs image formation with the toner.

2. Description of the Prior Art

Conventionally, in image forming apparatuses using toner, such as copiers, facsimile machines, etc., a toner supply device using a toner cartridge is used to supply toner to the developing unit to thereby achieve continuous operation of image output.

Examples of generally known methods for supplying toner to the developing unit include: a configuration in which toner stored in a toner cartridge is directly supplied to the developing unit (see Japanese Patent Application Laid-open 2003-162143); and a configuration in which toner in a toner cartridge is supplied by a screw from a predetermined position to the developing unit (see Japanese Patent Application Laid-open Hei 10-142936).

From a viewpoint of recent upsurge of conservation of natural resources, there are some proposals of toner cartridges that can be recycled by refilling toner after the toner runs out (see Japanese Patent Application Laid-open 2001-312129). Further, there is also a proposal of a toner cartridge which can display the number of times of recycled usage (see Japanese Patent Application Laid-open Hei 9-288415).

However, some conventional toner cartridges have configurations that are not suitable for being recycled, others have the problems that loading of toner into the toner cartridge is troublesome and that toner which spills out from the toner loading opening when toner is loaded, contaminates the operator and apparatus, causing bad influence on work performance.

SUMMARY OF THE TECHNOLOGY

The present technology has been devised in view of the above conventional problems, it is therefore an object of the present technology to provide a toner container, into which toner can be simply loaded, which can be handled easily when the toner container is full of toner, and which can be easily recycled, as well as to provide a toner loading method whereby the work performance of toner loading can be improved by preventing contamination on the operator and the apparatus with the toner that spills out from the toner loading opening when toner is loaded.

The toner container and the toner loading method for solving the above problems are configured as follows.

A toner container according to the first aspect includes: a cylindrical toner storing portion to be filled with toner; a toner loading portion having a toner loading opening from which toner is loaded into the toner storing portion; a cap element which is able to hermetically close and open the toner loading opening; and a toner discharge port for discharging the toner stored in the toner storing portion out of the container, characterized in that the cap element is constructed so as to enclose the toner loading opening and be fastened by screw-fitting to the toner loading portion, and includes, as an engaging portion with the toner loading portion, a first projection capable of limiting the rotation of the cap element in a loosening direction; and the toner loading portion is formed at a first end side of the toner container and includes, as an engaging portion with the cap element, a second projection engaging the first projection and capable of limiting the rotation of the cap element in the loosening direction.

A toner container according to the second aspect is characterized in that, in addition to the configuration described in the above first aspect, the engagement between the first projection and the second projection is designed so that a stronger rotational force is needed when the engagement between the first projection and the second projection is released by rotating the cap element relative to the toner loading portion in the loosening direction than when the first projection and the second projection become engaged by rotating the cap element relative to the toner loading portion in the fastening direction.

A toner container according to the third aspect is characterized in that, in addition to the configuration described in the above first or second aspect, the toner discharge port is formed on a second end side that is opposite to the first end side where the toner loading portion of the toner container is formed, and is sealed by a sealing element bonded from without; the toner container includes a holder that encloses the outer periphery of the second end side where toner discharge port is formed and rotatably holds the toner container; and, the holder, when it encloses the second end side of the toner container, has an inner wall portion located opposing the toner discharge port that is hermetically closed by a sealing element.

A toner container according to the fourth aspect is characterized in that, in addition to the configuration described in any one the above first to third aspects, the container further includes an electric recording medium for storing information on the toner container, and the information can be read out in an image forming apparatus in which the toner container is set.

A toner container according to the fifth aspect of is characterized in that, in addition to the configuration described in the above fourth aspect, the information at least includes the number of times the toner container was recycled or the ID information of the toner being filled.

A toner loading method according to the sixth aspect is a toner loading method for loading toner into a toner container that includes: a cylindrical toner storing portion to be filled with toner; a toner loading portion having a toner loading opening from which toner is loaded into the toner storing portion; a cap element which is able to hermetically close and open the toner loading opening; and a toner discharge port for discharging the toner stored in the toner storing portion out of the container, and comprises the step of: loading toner into the toner storing portion of the toner container with the toner loading opening placed up; and suctioning air around the toner loading portion while toner is being loaded into the toner storing portion.

A toner loading method according to the seventh aspect is characterized in that, in addition to the configuration of the above sixth aspect, one of the toner containers described in the first to fifth aspects is used as the aforementioned toner container.

A toner container according to the first aspect is adapted to include: a cylindrical toner storing portion to be filled with toner; a toner loading portion having a toner loading opening from which toner is loaded into the toner storing portion; a cap element which is able to hermetically close and open the toner loading opening; and a toner discharge port for discharging the toner stored in the toner storing portion out of the container, and the cap element is constructed so as to enclose the toner loading opening and be fastened by screw-fitting to the toner loading portion. Accordingly, this configuration enables easy removal of the cap element from the toner container, hence it is possible to improve the work efficiency of the toner loading operation as well as to facilitate recycling of the toner container.

Further, the cap element includes, as an engaging portion with the toner loading portion, a first projection capable of limiting the rotation of the cap element in a loosening direction; and the toner loading portion is formed at a first end side of the toner container and includes, as an engaging portion with the cap element, a second projection engaging the first projection and capable of limiting the rotation of the cap element in the loosening direction. Accordingly, this configuration facilitates handling of the toner container without caring about toner leakage since the cap element will not come off unexpectedly due to a user's operational error.

In addition to the above common effect that is obtained from the first to seventh aspects, each aspect has the following effect.

Detailedly, according to the second aspect since the engagement between the first projection and the second projection is designed so that a stronger rotational force is needed when the engagement between the first projection and the second projection is released by rotating the cap element relative to the toner loading portion in the loosening direction than when the first projection and the second projection become engaged by rotating the cap element relative to the toner loading portion in the fastening direction, this configuration, in addition to the effect achieved by the first aspect, makes it possible to perform a locking operation with a smaller force when the cap element is closed after toner loading while it is possible to prevent the cap element from loosening and reliably keep its locked state even when it was attempted to rotate the cap element in its loosening direction by mistake.

The toner discharge port according to the third aspect is formed on a second end side that is opposite to the first end side where the toner loading portion of the toner container is formed, and is sealed by a sealing element bonded from without; the toner container includes a holder that encloses the outer periphery of the second end side where toner discharge port is formed and rotatably holds the toner container; and, the holder, when it encloses the second end side of the toner container, has an inner wall portion located opposing the toner discharge port that is hermetically closed by a sealing element. With this configuration, if the pressure of the loaded toner acts on the toner discharge port while toner is being loaded via the toner loading portion into the toner container, during transportation of the toner container or in other cases, the sealing element that seals the toner discharge port is supported by the inner wall portion. Accordingly, the sealing element that seals the toner discharge port will never peel off unexpectedly. Thus, in addition to the effect achieved by the first or second aspect it is possible to facilitate the toner loading operation as well as transportation of the toner container without causing any contamination on the operator and apparatus with spilt toner.

Since the toner container according to the fourth aspect further includes an electric recording medium for storing information on the toner container, and the information can be read out in an image forming apparatus in which the toner container is set, this configuration, in addition to the effect achieved by any one of the first to third aspects, facilitates confirmation of the usage history and recycled condition of the toner container being used.

Since the information according to the fifth aspect at least includes the number of times the toner container was recycled or the ID information of the toner being filled, this configuration, in addition to the effect achieved by fourth aspect, facilitates confirmation of the usage history and recycled condition of the toner container being used.

According to the sixth aspect, a toner loading method for loading toner into a toner container that includes: a cylindrical toner storing portion to be filled with toner; a toner loading portion having a toner loading opening from which toner is loaded into the toner storing portion; a cap element which is able to hermetically close and open the toner loading opening; and a toner discharge port for discharging the toner stored in the toner storing portion out of the container, comprises the step of: loading toner into the toner storing portion of the toner container with the toner loading opening placed up; and suctioning air around the toner loading portion while toner is being loaded into the toner storing portion. This configuration makes it possible to efficiently load the toner into the bottle from the toner loading opening without causing any contamination on the operator and apparatus with the toner spilt from the toner loading opening during toner loading. Hence, it is possible to markedly improve the work performance.

Since one of the toner containers described in the first to fifth aspects is used as the aforementioned toner container, this, in addition to the effect achieved by the sixth aspect, enables easy removal of the cap element from the toner container, thus making it possible to improve the work performance of the toner loading operation.

DESCRIPTION OF THE PREFERRED EMBODIMENTS

The best mode for carrying out the present technology will be described with reference to the drawings.

Figure 1:
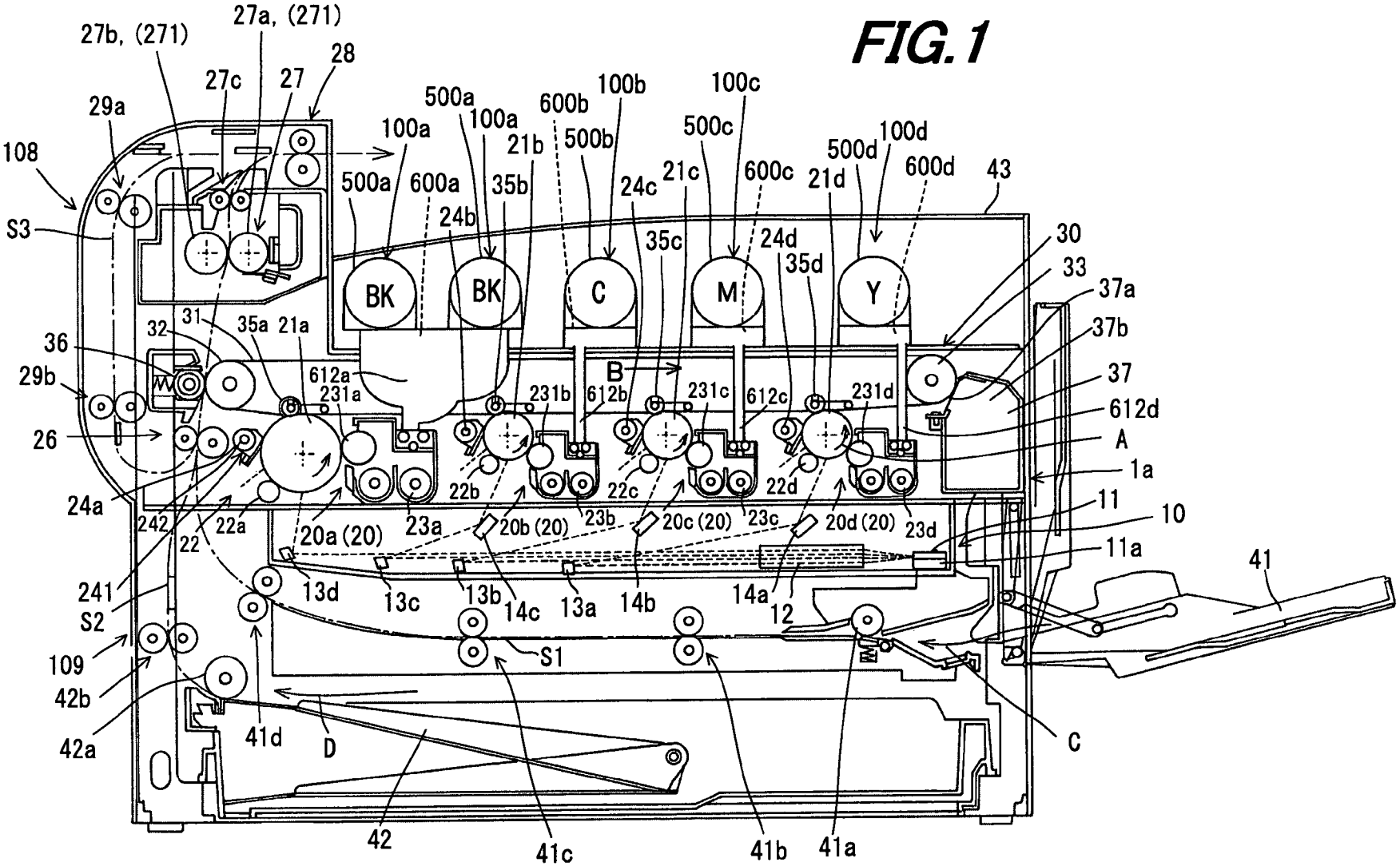
FIG. 1 is an illustrative view showing an overall configuration of an image forming apparatus using a toner container.

FIG. 1 is an illustrative view showing an overall configuration of an image forming apparatus using a toner container.

Figure 3:
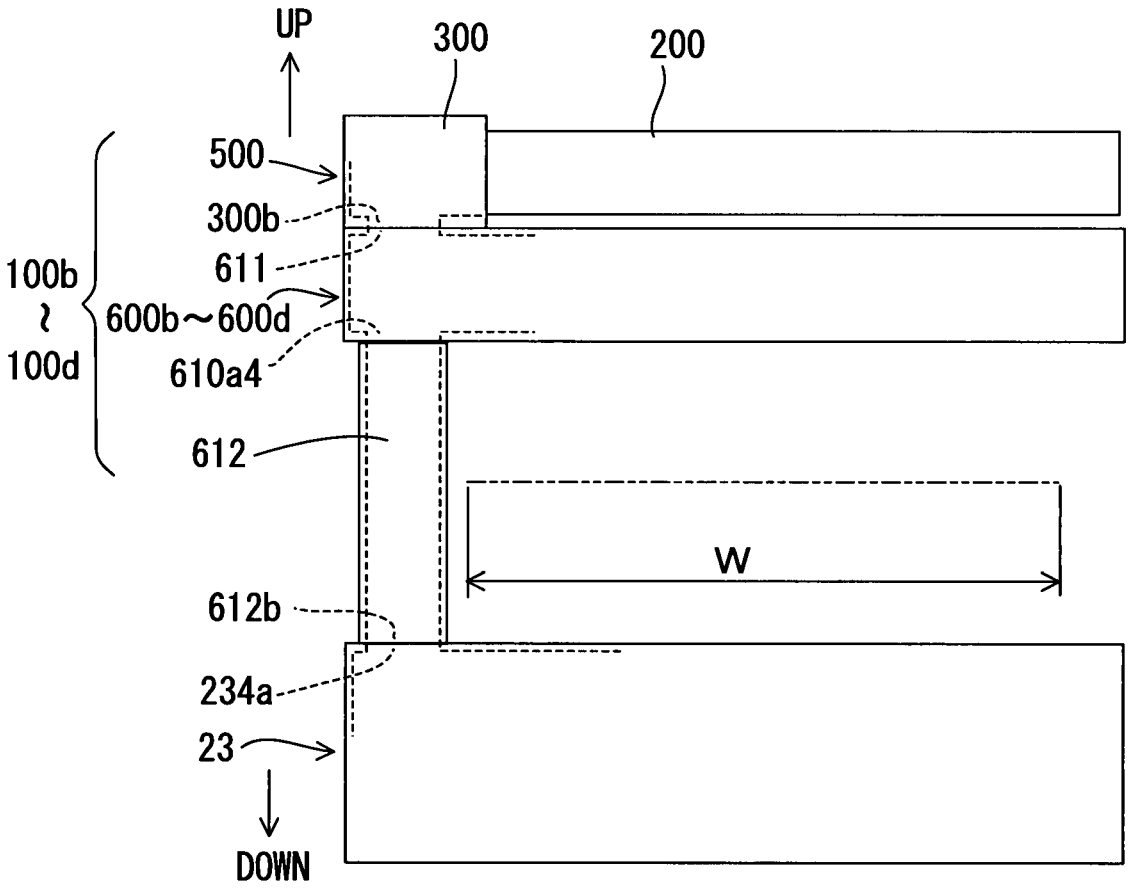
FIG. 3 is an overall front view showing the developing unit and toner supply device.

As shown in FIG. 1, the present embodiment is applied to an image forming apparatus 1 in which developer images formed on photoreceptor drums 21 (21*a*, 21*b*, 21*c* and 21*d*) with developers (toners) which are supplied from developing rollers 231 (231*a*, 231*b*, 231*c* and 231*d*) in accordance with image data are transferred to a recording sheet by a transfer process, and includes toner supply devices 100 (100*a*, 100*b*, 100*c* and 100*d*) each having a toner bottle (toner container) 200 (200*a*, 200*b*, 200*c* or 200*d*: FIG. 3) for supplying toner to developing unit 23 so as to perform image output by automatic toner supply to the developing units 23 (23*a*, 23*b*, 23*c* and 23*d*).

As shown in FIG. 1, image forming apparatus according to the present embodiment includes: a plurality of process printing units (image forming means) 20 (20*a*, 20*b*, 20*c* and 20*d*) each having a photoreceptor drum 21 (21*a*, 21*b*, 21*c* or 21*d*) on which a developer image (which will be referred to as "toner image" hereinbelow) is formed with a developer (which will be referred to as "toner" hereinbelow) corresponding to the color of color-separated image information and a developing unit 23 (23*a*, 23*b*, 23*c* and 23*d*) for supplying the toner to the photoreceptor drum 21 surface; an exposure unit (light scanning device) 10 for creating electrostatic latent images on photoreceptor drums 21 of individual colors by illumination of laser beams in accordance with image information; a transfer belt unit 30 having an endless transfer belt 31 for conveying toner images; and a fixing unit 27 for thermally fixing the toner images transferred to recording paper, by means of a heat roller 27*a* and a pressing roller 27*b*.

To begin with, the overall configuration of image forming apparatus 1 will be described.

As shown in FIG. 1, image forming apparatus 1 according to the present embodiment is a so-called digital color printer which is adapted to output a color image by separating image information into colors and forming images of individual colors, is mainly composed of an image forming portion 108 and a paper feed portion 109, and forms multi-color images or monochrome images on recording paper in accordance with a print job sent from an information processor (not illustrated) such as a personal computer etc., externally connected.

Image forming portion 108 forms multi-color images based on electrophotography with yellow (Y), magenta (M), cyan (C) and black (BK) colors. This image forming portion is mainly composed of exposure unit 10, process printing units 20, fixing unit 27, a transfer belt unit 30 having transfer belt 31 as a transfer means, transfer roller 36 and a transfer belt cleaning unit 37.

In the overall arrangement of image forming portion 108, fixing unit 27 is disposed on the top at one end side of a housing 1*a* of image forming apparatus 1, transfer belt unit 30 is extended under the fixing unit 27 from one end side to the other end side of housing 1*a*, process printing units 20 are disposed under the transfer belt unit 30, and exposure unit 10 is disposed under the process printing units 20.

Further, transfer belt cleaning unit 37 is arranged on the other end side of transfer belt unit 30. Also, a paper output tray 43 is arranged contiguous to fixing unit 27, over image forming portion 108. Paper feed portion 109 is arranged under the image forming portion 108.

In the present embodiment, as process printing units 20, four process printing units 20*a*, 20*b*, 20*c* and 20*d*, corresponding to individual colors, i.e., black (BK), cyan (C), magenta (M) and yellow (Y) are arranged sequentially along transfer belt 31.

These process printing units 20(20*a*, 20*b*, 20*c* and 20*d*) are arranged in parallel to each other, in the approximately horizontal direction (in the left-to-right direction in the drawing) in housing 1*a*, and include respective photoreceptor drums 21 (21*a*, 21*b*, 21*c* and 21*d*) as the image support for each individual associated color, respective chargers (charging means) 22 (22*a*, 22*b*, 22*c* and 22*d*) for charging the photoreceptor drums 21, respective developing units (developing means) 23 (23*a*, 23*b*, 23*c* and 23*d*) and respective cleaner units 24 (24*a*, 24*b*, 24*c* and 24*d*) and other components.

Here, the symbols a, b, c, and d added to the constituents for individual colors show correspondence to black (BK), cyan (C), magenta (M) and yellow (Y) respectively. In the description hereinbelow, however, the constituents provided for each color are generally referred to as photoreceptor drum 21, charger 22, developing unit 23, and cleaner unit 24, except in the case where the constituents corresponding to a specific color need to be specified and described.

Photoreceptor drum 21 is arranged so that part of its outer peripheral surface comes into contact with the surface of transfer belt 31 while charger 22 as an electric field generator, developing unit 23 and cleaner unit 24 are arranged along, and close to, the outer peripheral surface of the drum.

As charger 22, a corona-wire charger is used and arranged, at a position on the approximately opposite side across photoreceptor drum 21, from transfer belt unit 30 and close to the outer peripheral surface of photoreceptor drum 21. Though in the present embodiment a corona-wire charger is used as charger 22, any type of charger can be used without limitation, in place of the corona-wire charger, such as a fur brush type charger, magnetic brush type charger, roller-type charger, saw-toothed type charger, ion-generation charging device etc., as long as it can provide the desired charge performance to the photoreceptor drum.

Developing units 23*a*, 23*b*, 23*c* and 23*d* hold associated toners of black (BK), cyan (C), magenta (M) and yellow (Y) colors, each developing unit 23 being arranged on the downstream side of charger 22 with respect to the rotational direction of the photoreceptor drum (in the direction of arrow A in the drawing).

In developing units 23*a*, 23*b*, 23*c* and 23*d*, in order to deal with high-speed and large-volume printing, toner supply devices 100*a*, 100*b*, 100*c* and 100*d* equipped with five toner supply assemblies 500*a*, 500*b*, 500*c* and 500*d* for supplying developers to respective developing units 23*a*, 23*b*, 23*c* and 23*d* are provided. Developing rollers 231*a*, 231*b*, 231*c* and 231*d* are arranged opposing respective photoreceptor drums 21*a*, 21*b*, 21*c* and 21*d*, so as to supply the associated colors of toners to the electrostatic latent images formed on the outer peripheral surfaces of photoreceptor drums 21*a*, 21*b*, 21*c* and 21*d*, respectively to visualize them.

As the toner to be supplied, toners of black (BK), cyan (C), magenta (M) and yellow (Y) colors are stored in toner supply assemblies 500*a*, 500*b*, 500*c* and 500*d*, respectively.

Here, two toner supply assemblies 500*a* for black (BK) toner are arranged side by side in order to support large-volume printing, taking into account the practice that monochrome printing is usually used most frequently.

Each toner supply assembly 500 is arranged at a position approximately directly above the developing unit 23 for performing development with the corresponding toner, and is connected to the corresponding developing unit 23 by means of a toner supply passage part 612 (612*a*, 612*b*, 612*c* or 612*d*).

Here, supply passage part 612*a* for supplying the black (BK) toner is constructed so that the toner from two toner supply devices 100*a* and 100*a* can be put together and supplied to developing unit 23*a*.

Cleaner unit 24 is arranged on the upstream side of charger 22 with respect to the rotational direction of the photoreceptor drum. Cleaner unit 24 has a cleaning blade 241 and is configured so that the cleaning blade 241 is positioned in abutment with the outer peripheral surface of photoreceptor drum 21 so as to scrape and collect the leftover toner off the photoreceptor drum 21. A reference numeral 242 in the drawing designates a conveying screw for conveying the collected toner.

In the present embodiment, cleaning blade 241 is used but the cleaning unit is not limited to this configuration. One or more cleaning blades may be used or a fur-brush or magnetic brush may be used alone. Alternatively, a fur-brush or magnetic brush may be used in combination with a cleaning blade. That is, any configuration may be used as long as it can scrape and collect the leftover toner off the photoreceptor drum 21.

Exposure unit 10 is mainly composed of a box-shaped housing, a laser scanning unit (LSU) 11 having a laser illuminator 11*a* incorporated therein, a polygon mirror 12 and reflection mirrors 13*a*, 13*b*, 13*c*, 13*d*, 14*a*, 14*b* and 14*c* etc. for reflecting the laser beams for associated colors.

The laser beam emitted from the laser illuminator of laser scanning unit 11 is separated into color components by polygon mirror 12 and an unillustrated f-θ lens, then the separated components of light are reflected by reflection mirrors 13*a* to 13*d* and 14*a* to 14*c* to illuminate the respective photoreceptor drums 21*a*, 21*b*, 21*c* and 21*d* of individual colors.

Here, concerning laser scanning unit 11, a writing head made up of an array of light emitting devices such as EL (electro luminescence), LED (light emitting diode) and others, may be used instead of the laser illuminator. Also, a light source in combination with a liquid crystal shutter may be used. That is, any configuration can be used as long as it can create an electrostatic latent image on the photoreceptor drum 21 surface.

As shown in FIG. 1, transfer belt unit 30 is essentially composed of transfer belt 31, a transfer belt drive roller 32, a transfer belt driven roller 33 and intermediate transfer rollers 35*a*, 35*b*, 35*c* and 35*d*.

In the following description, any of intermediate transfer rollers 35*a*, 35*b*, 35*c* and 35*d* will be referred to as intermediate transfer roller 35 when general mention is made.

Transfer belt 31 is formed of an endless film of about 75 μm to 120 μm thick. Transfer belt 31 is essentially made from polyimide, polycarbonate, thermoplastic elastomer alloy or the like.

Also, transfer belt 31 is tensioned by transfer belt drive roller 32, transfer belt driven roller 33 and intermediate transfer rollers 35 so that its surface comes into contact with the outer peripheral surfaces of photoreceptor drums 21, and is adapted to move in the auxiliary scan direction (in the direction of arrow B in the drawing) by the driving force of the transfer belt drive roller 32.

Transfer belt drive roller 32 is disposed at one end side of housing 1*a* and drives the transfer belt 31 by applying a driving force to transfer belt 31 whilst nipping and pressing the transfer belt 31 and a recording sheet together between itself and transfer roller 36 to convey the recording sheet.

Transfer belt driven roller 33 is disposed on the other end side of housing 1*a*, so as to suspend and tension the transfer belt 31 approximately horizontally from the fixing unit 27 side to the other end side of housing 1*a*, in cooperation with transfer belt drive roller 32. However, if the dimension in the width direction of image forming apparatus 1 in FIG. 1 needs to be smaller, that is, if the foot print is made smaller with respect to the width direction in order to achieve space-saving, the position of transfer belt drive roller 32 may be displaced so that transfer belt 31 is inclined in either way from the fixing unit 27 side to the other of housing 1*a* while the photoreceptors, developing units, laser illuminator, fixing unit and other components may be rearranged and resized as appropriate in association with that change in layout.

Intermediate transfer rollers 35 are arranged in the interior space of transfer belt 31 wound between transfer belt drive roller 32 and transfer belt driven roller 33 and positioned with their axes displaced relative to corresponding photoreceptor drums 21, in the lateral direction in the drawing, to the downstream side with respect to the moving direction of transfer belt 31, so as to press the inner surface of transfer belt 31 and bring its outer peripheral surface into contact with part of the outer peripheral surface of each photoreceptor drum 21, forming a predetermined amount of nip.

Further, intermediate transfer roller 35 is formed of a metal (e.g., stainless steel) shaft having a diameter of 8 to 10 mm and a conductive elastic material such as EPDM, foamed urethane etc., coated on the outer peripheral surface of the metal shaft. However, the configuration should not be limited to use of these elastic materials.

The thus formed intermediate transfer roller 35 is applied with a high-voltage transfer bias for transferring the toner image formed on photoreceptor drum 21 to transfer belt 31, i.e., a high voltage of a polarity (+) opposite to the polarity (−) of the electrostatic charge on the toner, so as to apply a uniform high voltage from the elastic material to transfer belt 31.

The visualized toner images (electrostatic images) formed on the photoreceptor drums 21 correspondingly to respective colors are transferred one over another on transfer belt 31, reproducing the image information that has been input to the apparatus. The thus formed laminated image information is transferred to the recording sheet by transfer roller 36 disposed at its contact point with transfer belt 31.

Transfer roller 36 as a constituent of the transfer means is a means for transferring the toner image transferred to transfer belt 31 to recording paper, and is arranged opposing transfer belt drive roller 32 at approximately the same level and in parallel thereto and pressing against the transfer belt 31 wound on the transfer belt driver roller 32, forming a predetermined nip therewith while being applied with a high voltage of a polarity (+) opposite to the polarity (−) of the static charge on the toner, for transferring the multi-color toner image formed on the transfer belt 31 to the recording paper.

In order to produce a constant nip between transfer belt 31 and transfer roller 36, either transfer belt drive roller 32 or transfer roller 36 is formed of a hard material such as metal or the like while the other roller is formed of a soft material such as elastic rubber, foamed resin, etc.

A registration roller 26 is provided under transfer belt drive roller 32 and transfer roller 36. This registration roller 26 is configured so as to deliver the recording sheet that is fed from paper feed portion 109 toward the transfer roller 36 side by aligning the front end of the sheet with the leading end of the toner image on transfer belt 31.

Since the toner adhering to transfer belt 31 as the belt comes in contact with photoreceptor drums 21, or the toner which has not been transferred to the recording sheet by transfer roller 36 and remains on transfer belt 31, would cause color contamination of toners at the next operation, transfer belt cleaning unit 37 is adapted to remove and collect such toner.

Transfer belt cleaning unit 37 includes: a cleaning blade 37*a*, located near transfer belt driven roller 33 and arranged so as to abut (come into sliding contact with) transfer belt 31; and a box-like toner collector 37*b* for temporarily holding the left over toner, remained on and scraped from transfer belt 31 by the cleaning blade 37*a*, to thereby scrape and collect the leftover toner off the transfer belt 31 surface.

Also, transfer belt cleaning unit 37 is arranged near process printing unit 20*a*, on the upstream side of the process printing unit 20*a* with respect to the moving direction of transfer belt 31. Further, transfer belt 31 is supported from its interior side by transfer belt driven roller 33, at the portion where cleaning blade 37*a* comes into contact with the outer surface of transfer belt 31.

Fixing unit 27 includes: as shown in FIG. 1, a pair of fixing rollers 271 consisting of a heat roller 27*a* and pressing roller 27*b*; and a conveying roller 27*c* above the fixing rollers 271. A recording sheet is input from below fixing rollers 271 and output upward towards conveying roller 27*c*.

Above fixing unit 27 a paper discharge roller 28 is arranged so that the recording sheet conveyed from conveying roller 27*c* is discharged by the paper discharge roller 28 onto paper output tray 43.

Referring to the fixing of a toner image by fixing unit 27, a heating device (not shown) such as a heater lamp or the like, provided inside or close to heat roller 27*a* is controlled based on the detected value from a temperature detector (not shown) so as to keep heat roller 27*a* at a predetermined temperature (fixing temperature) while the recording sheet with a toner image transferred thereon is heated and pressed between heat roller 27*a* and pressing roller 27*b* as it is being conveyed and rolled thereby, so that the toner image is thermally fused onto the recording sheet.

A duplex printing paper path S3 for double-sided printing is constructed adjacent to fixing unit 27, from the rear side of fixing unit 27 downward to the vicinity of paper feed portion 109. Conveying rollers 29*a* and 29*b* are arranged at the top and bottom and along the duplex printing paper path S3, thereby the recording sheet is inverted and delivered again toward transfer roller 36.

Specifically, conveying roller 29*a* is disposed at the rear of fixing unit 27 and conveying roller 29*b* is located, below conveying roller 29*a* with respect to the top and bottom direction, and at approximately the same level as registration roller 26.

In the present embodiment, heat roller 27*a* using a heating means made up of a heater lamp etc., is used with pressing roller 27*b*, but an induction heating type heating means may be used alone or in combination. Further, it is not necessary to use a roller as a means for applying pressure. That is, any appropriate method can be used as long as it can uniformly fix the toner image to the paper with heat without causing any image disturbance.

Paper feed portion 109 includes a manual feed tray 41 and paper feed cassette 42 for holding recording paper to be used for image forming, and is adapted to deliver recording paper, sheet by sheet, from manual feed tray 41 or paper feed cassette 42 to image forming portion 108.

As shown in FIG. 1, manual feed tray 41 is arranged at one side end (on the right side in the drawing) of housing 1*a* of image forming apparatus 1 so that it can be unfolded outside when used and folded up to the one end side when unused. This tray delivers paper, sheet by sheet, into the housing 1*a* of image forming apparatus 1 when the user places a few recording sheets (necessary number of sheets) of a desired type.

Arranged inside housing 1*a* of image forming apparatus 1 on the downstream side with respect to the manual feed tray 41's paper feed direction of recording paper (the direction of arrow C in the drawing) is a pickup roller 41*a* at the side of exposure unit 10. A conveying roller 41*b* is also disposed at approximately the same level further downstream with respect to the paper feed direction.

Pickup roller 41*a* touches one edge part of the surface of the recording sheet that is fed from manual feed tray 41 and reliably conveys the paper, sheet by sheet, by the function of roller's frictional resistance.

The aforementioned pickup roller 41*a* and conveying rollers 41*b*, 41*c* and 41*d* constitute a recording paper conveying path S1.

On the other hand, paper feed cassette 42 is arranged under the image forming portion 108 and exposure unit 10 in housing 1*a*, so as to accommodate a large amount of recording sheets of a size specified by the specification of the apparatus or of a size that is determined beforehand by the user.

Arranged above one end side (the left-hand side in the drawing) of paper feed cassette 42 is a pickup roller 42*a*. A conveying roller 42*b* is also provided on the downstream side of the pickup roller 42*a* with respect to the pickup roller 42*a*'s feed direction of recording paper.

Pickup roller 42*a* touches one edge part of the surface of the topmost sheet of the recording sheets set on the paper feed cassette 42 in response to a printout request and reliably picks up and feeds the paper, sheet by sheet, by the function of roller's frictional resistance.

Conveying roller 42*b* conveys the recording sheet delivered from pickup roller 42*a* upward along a recording sheet feed path S2 formed on one end side inside housing 1*a* to image forming portion 108.

Next, image output by image forming apparatus 1 of the present embodiment will be described.

Image forming apparatus 1 is constructed so as to transfer the toner images formed on photoreceptor drums 21 to a recording sheet fed from paper feed portion 109 by a so-called intermediate transfer process (offset process) via transfer belt 31.

First, charger 22 uniformly electrifies the outer peripheral surface of photoreceptor drum 21 at a predetermined voltage. Each electrified photoreceptor drum 21 is irradiated with a laser beam from exposure unit 10, so that an electrostatic latent image for each color is formed on the photoreceptor drum 21 for the color.

Next, toner is supplied from developing units 23 (23*a*, 23*b*, 23*c* and 23*d*) to the outer peripheral surfaces of photoreceptor drums 21 (21*a*, 21*b*, 21*c* and 21*d*) so that the static latent images formed on the outer peripheral surfaces of photoreceptor drums 21 are visualized with toner so as to form toner images.

Then, the toner images formed on photoreceptor drums 21 are transferred to transfer belt 31.

Transfer of the toner image from photoreceptor drum 21 to transfer belt 31 is done by application of a high voltage from intermediate transfer roller 35 arranged in contact with the interior side of transfer belt 31.

As intermediate transfer roller 35 is applied with a high voltage of a polarity (+) opposite to that of the polarity (−) of the electrostatic charge on the toner, transfer belt 31 has a high potential uniformly applied by the intermediate transfer roller 35, presenting the opposite polarity (+). Thereby, the toner image bearing negative (−) charge on photoreceptor drum 21 is transferred to transfer belt 31 as the photoreceptor drum 21 turns and comes into contact with transfer belt 31.

The toner images of colors formed on respective photoreceptor drums 21 are transferred to transfer belt 31, laid over, one over another, in the order of yellow (Y), magenta (M), cyan (C) and black (BK) as transfer belt 31 moves to come into contact with each of the rotating photoreceptor drums 21, forming a color toner image on transfer belt 31.

In this way, the toner images developed from static latent images on photoreceptor drums 21 for every color, are laminated on transfer belt 31 so that the image for printing is reproduced as a multi-color toner image on transfer belt 31.

Then, as transfer belt 31 moves and reaches the position where the recording sheet and the transfer belt 31 meet, the multi-color toner image having been transferred on transfer belt 31 is transferred from transfer belt 31 to the recording sheet by the function of transfer roller 36.

Since the toner adhering to transfer belt 31 as the belt comes in contact with photoreceptor drums 21, or the toner which has not been transferred to the recording sheet by the function of transfer roller 36 and remains on transfer belt 31, would cause color contamination of toners at the next operation, it is removed and collected by transfer belt cleaning unit 37.

Next, the operation of feeding recording sheets by paper feed portion 109 will be described.

When the recording paper placed on manual feed tray 41 is used, as shown in FIG. 1 the paper is taken in by pickup roller 41*a* from manual feed tray 41, sheet by sheet, at controlled timings in accordance with the instructions from a control panel (not shown), and fed into the machine.

The recording sheet thus taken into the machine is conveyed along recording paper feed path S1 by conveying roller 41*b* to image forming portion 108.

When the recording paper accommodated in paper feed cassettes 42 is used, the paper is separated and fed from paper feed cassette 42, sheet by sheet, by pickup roller 42*a* in accordance with a printout request and conveyed by conveying roller 42*b* along recording paper feed path S2 to image forming portion 108 located above.

The recording sheet conveyed from manual feed tray 41 or paper feed cassette 42 is delivered to the transfer roller 36 side, by registration roller 26, at such a timing as to bring the front end of the recording sheet in register with the leading end of the toner image on transfer belt 31, so that the toner image on transfer belt 31 is transferred to the recording sheet.

The recording sheet with the toner image transferred thereon is conveyed approximately vertically and reaches fixing unit 27, where the toner image is thermally fixed to the recording sheet by heat roller 27*a* and pressing roller 27*b*.

When one-sided printing is requested, the recording sheet having passed through fixing unit 27 is discharged by discharge roller 28 and placed facedown on paper output tray 43.

In contrast, when double-sided printing is requested, the recording sheet is stopped and nipped at paper discharge roller 28, then the paper discharge roller 28 is rotated in reverse so that the recording sheet is guided to duplex printing paper path S3 and conveyed again to registration roller 26 by conveying rollers 29*a* and 29*b*.

By this movement, the printing face of the recording sheet is inverted and the direction of conveyance is reversed. Illustratively, the leading edge of the sheet at the first printing is directed to the trailing end when the underside is printed, or the trailing edge of the sheet at the first printing is directed to the leading end when the underside is printed.

After the toner image is transferred and thermally fixed to the underside of the recording sheet, the sheet is discharged onto paper output tray 43 by paper discharge roller 28.

Thus, the transfer operation to recording paper is performed.

Next, the configuration of developing unit 23 and toner supply device 100 according to the present embodiment will be described in detail with reference to the drawings.

Figure 2:
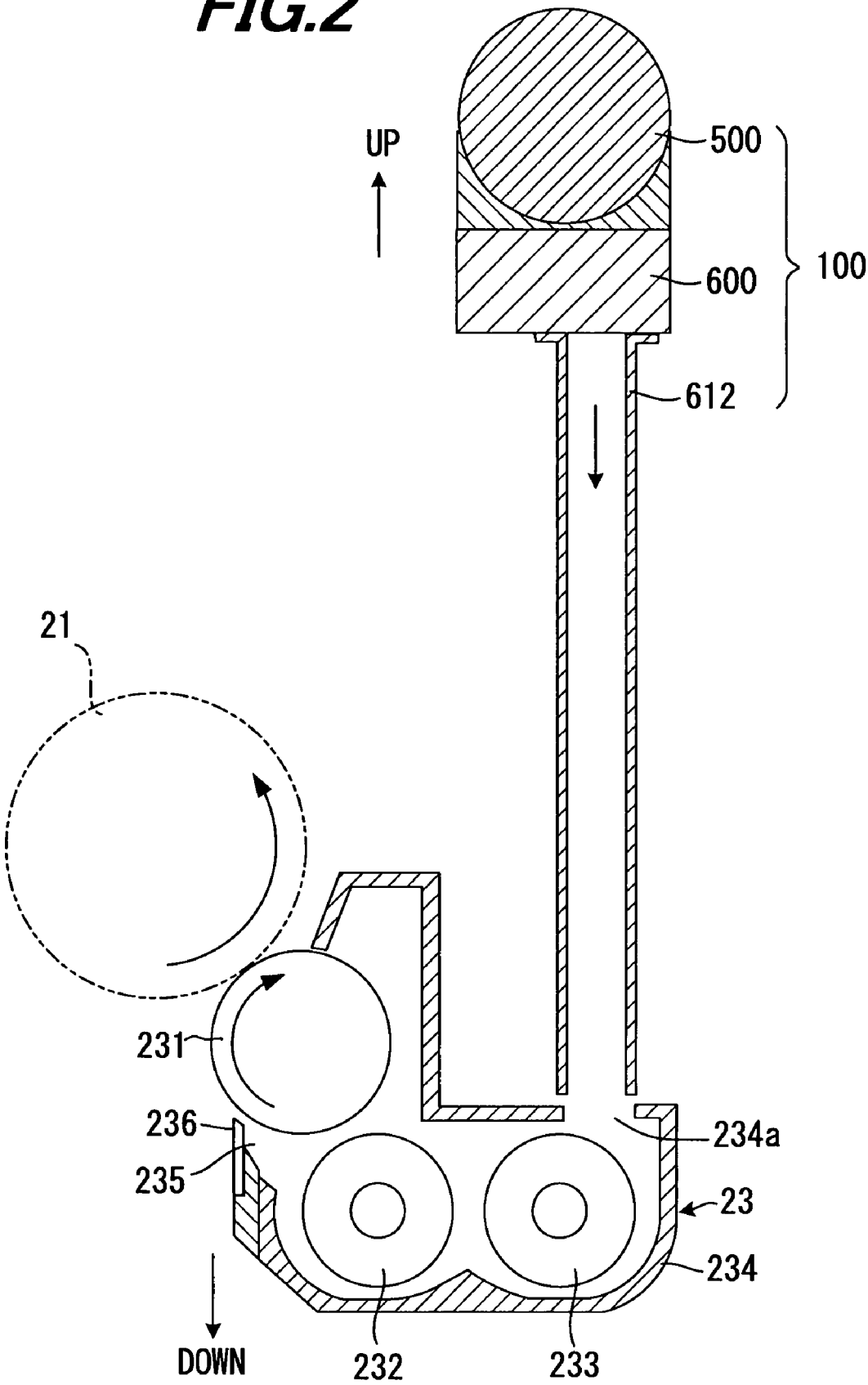
FIG. 2 is a schematic side sectional view showing a configuration of a developing unit and a toner supply device that constitute the image forming apparatus.
Figure 4:
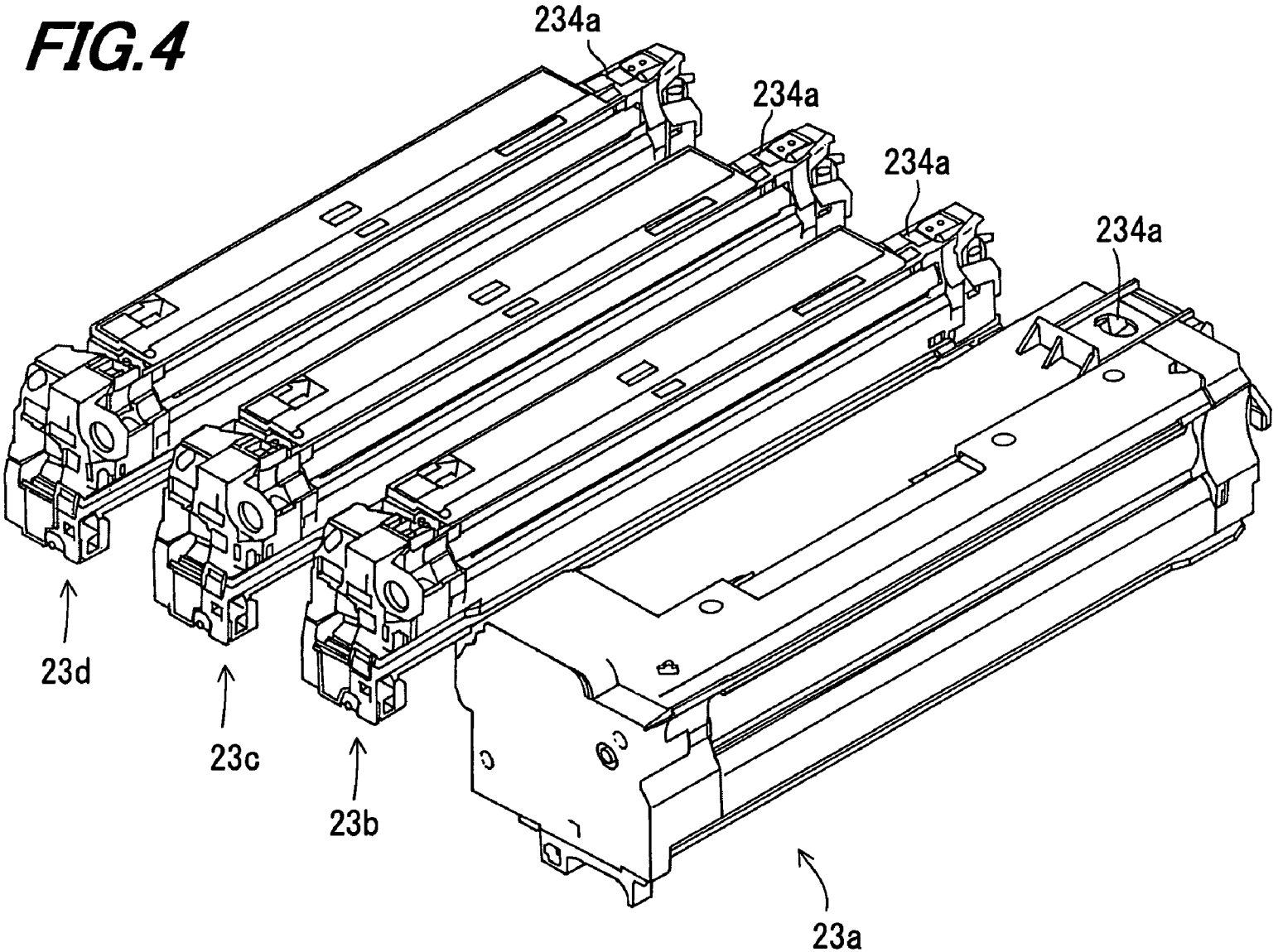
FIG. 4 is a perspective view showing the configuration of the developing unit.
Figure 5:
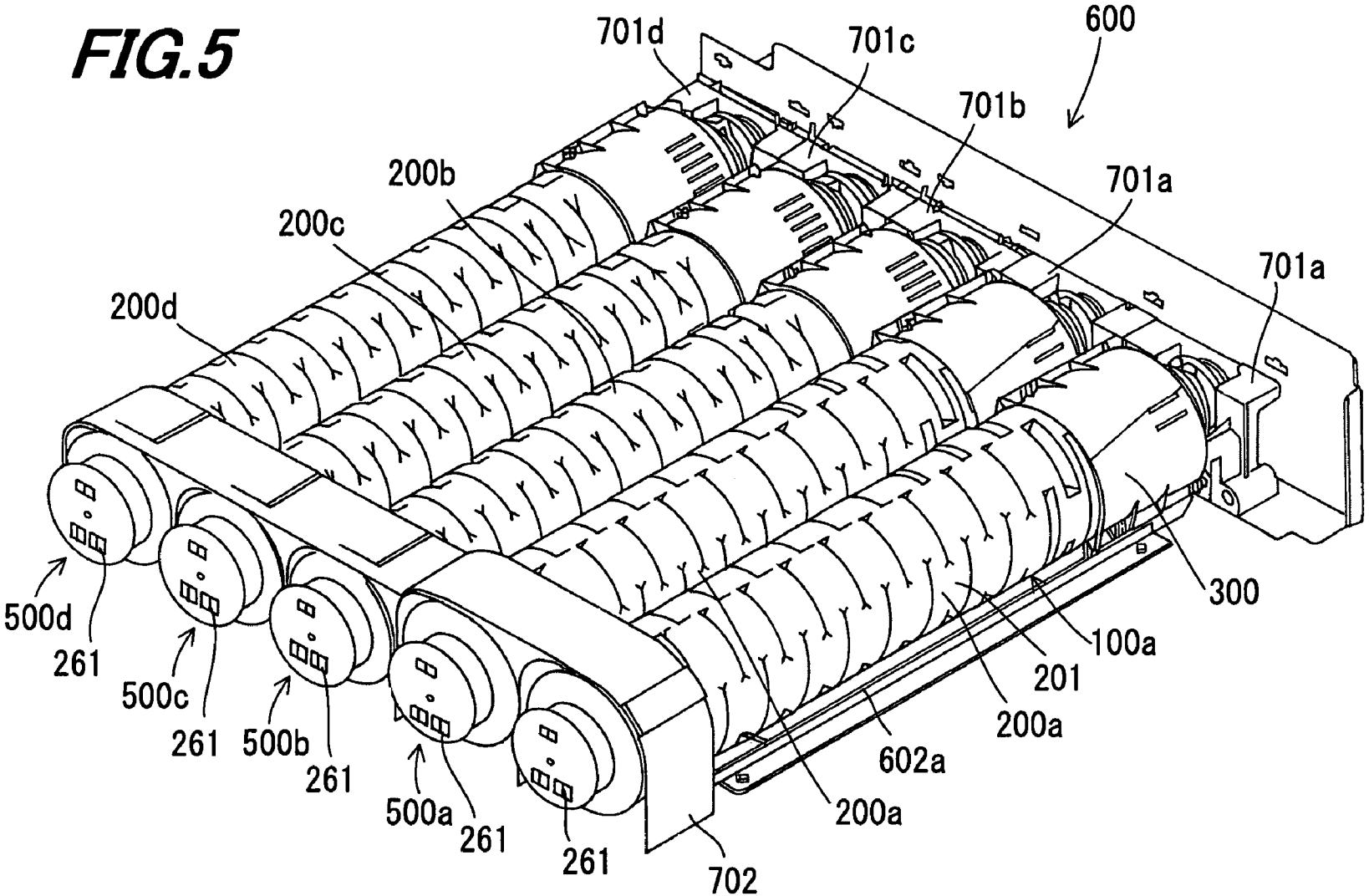
FIG. 5 is a perspective view showing a mounting example when toner supply assemblies are set in toner supply assembly mounting mechanisms that constitute the toner supply devices.
Figure 6:
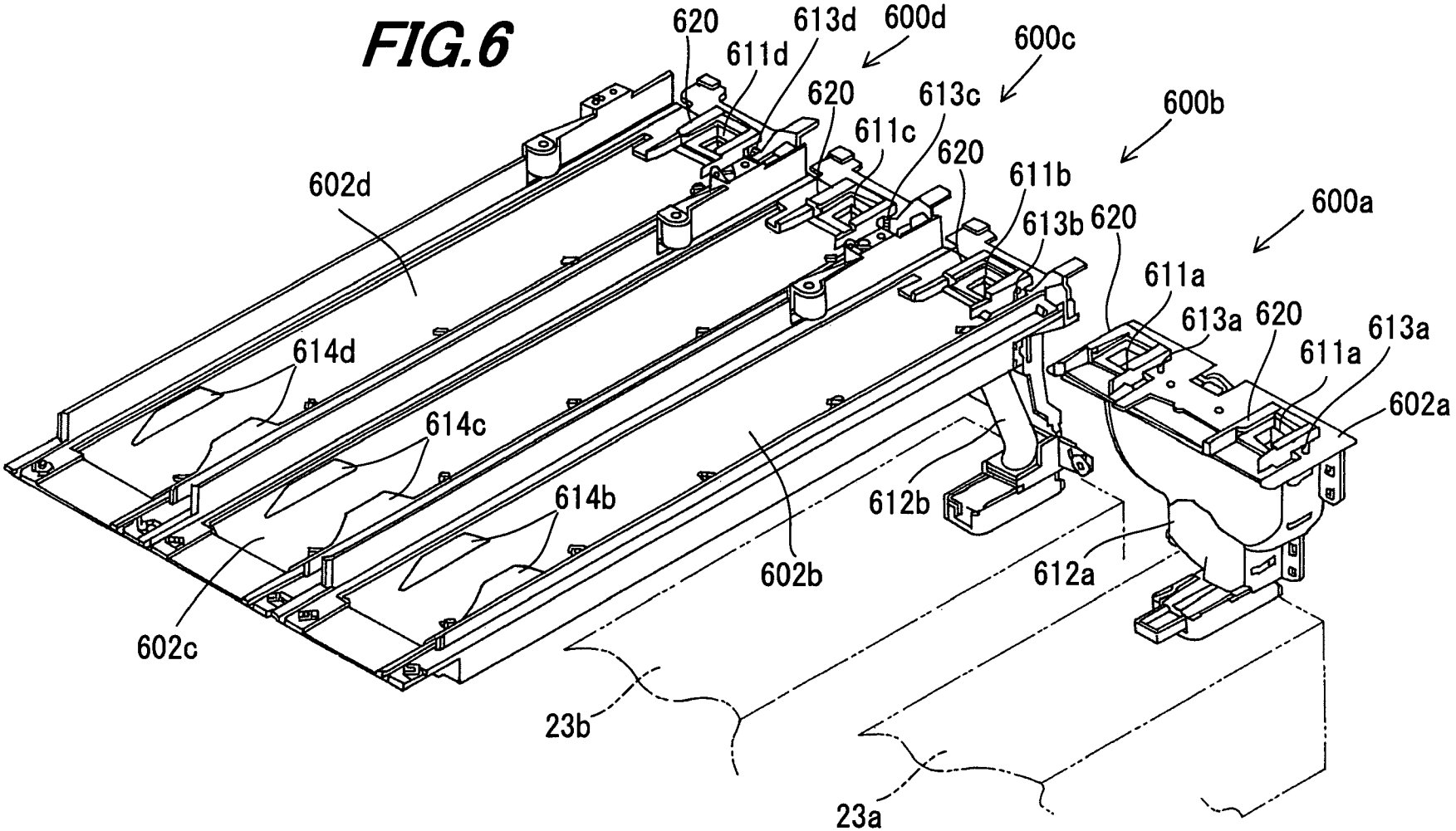
FIG. 6 is a perspective view showing the configuration of the toner supply assembly mounting mechanisms.

FIG. 2 is a schematic side sectional view showing a configuration of a developing unit and a toner supply device that constitute an image forming apparatus of the present embodiment; FIG. 3 is an overall front view showing the configuration of the developing unit and toner supply device; FIG. 4 is a perspective view showing the configuration of the developing unit mounted to the image forming apparatus according to the present embodiment; FIG. 5 is a perspective view showing a mounting example when toner supply assemblies are set in a toner supply assembly mounting mechanisms that constitute the toner supply devices according to the present embodiment; and FIG. 6 is a perspective view showing a configuration of the toner supply assembly mounting mechanisms.

To begin with, developing unit 23 will be described.

As shown in FIGS. 2 and 3, in developing unit 23, a toner input port 234*a* for leading the toner is formed as an opening at the top of a casing 234 that forms its exterior. The developing unit incorporates inside casing 234 a developing roller 231, a first toner conveying roller 232 and a second toner conveying roller 233, and is mounted to the image forming apparatus body with the developing roller 231 opposed, in abutment with, or close to, photoreceptor drum 21. This toner input port 234*a* of developing unit 23 is formed at a position further outside of the width W of the transfer belt, on the same side as a toner feed port 611 of a toner supply assembly mounting mechanism 600 is disposed.

First toner conveying roller 232 and second toner conveying roller 233 are disposed in the bottom of casing 234 in parallel with each other along the axis direction of developing roller 231 so that the toner that is fed into casing 234 is agitated with the developer and conveyed to developing roller 231. Developing roller 231 is arranged over and above first toner conveying roller 232 so as to be exposed from an opening mouth 235.

Casing 234 is a box-shaped configuration elongated in the direction (the width direction of the transfer belt) perpendicular to the direction of transfer (the transfer belt's direction of movement) when mounted in the image forming apparatus body, and is formed with opening mouth 235 so that developing roller 231 therein opposes photoreceptor drum 21 when developing unit 23 is mounted to the image forming apparatus body.

Opening mouth 235 is made open long across the width of casing 234 along the axis direction of developing roller 231 so that at least developing roller 231 will be able to oppose and abut photoreceptor drum 21. Provided along the bottom edge of opening mount 235 in the drawing is a blade 236 that extends in the axis direction of developing roller 231. Blade 236 is positioned so as to create a predetermined clearance between the blade 236 edge and the developing roller 231 surface, whereby a predetermined amount of toner can be supplied to the developing roller 231 surface through this clearance.

Arranged over the thus constructed developing unit 23 is toner supply device 100 (FIGS. 2 and 3).

Referring next to the drawings, the configuration of toner bottle 200 and toner supply device 100 according to the present embodiment will be described.

Figure 7A:
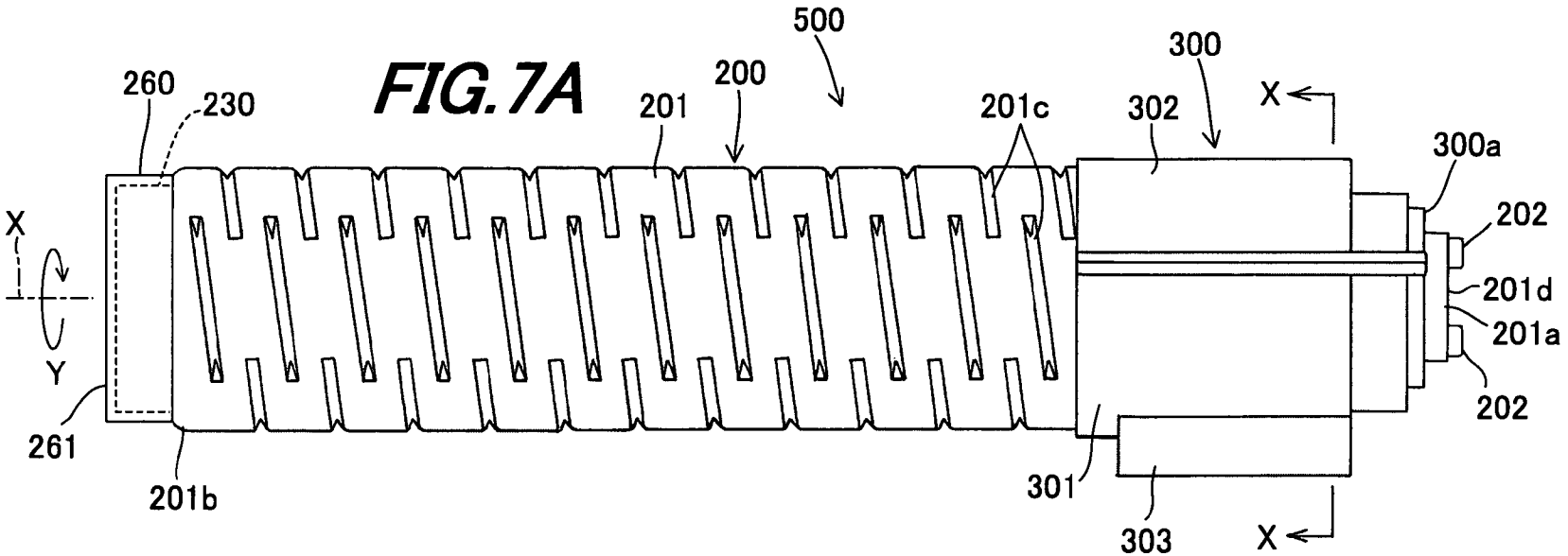
FIG. 7A is a side view showing a configuration of a toner supply assembly as a part of the toner supply device and FIG. 7B is its front view, viewed from the end face side of the toner supply assembly from which toner is supplied.
Figure 7B:
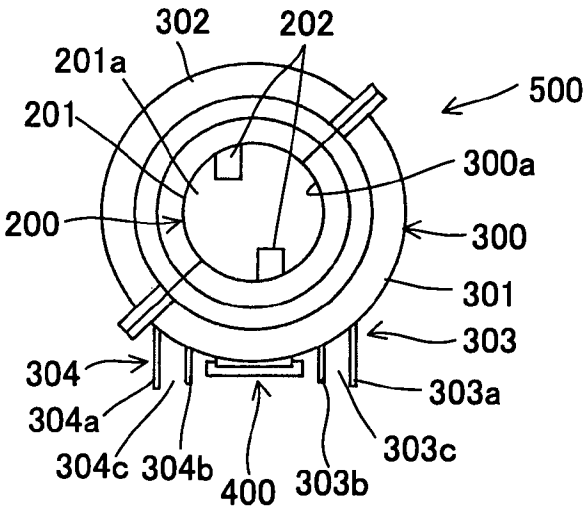
Figure 8:
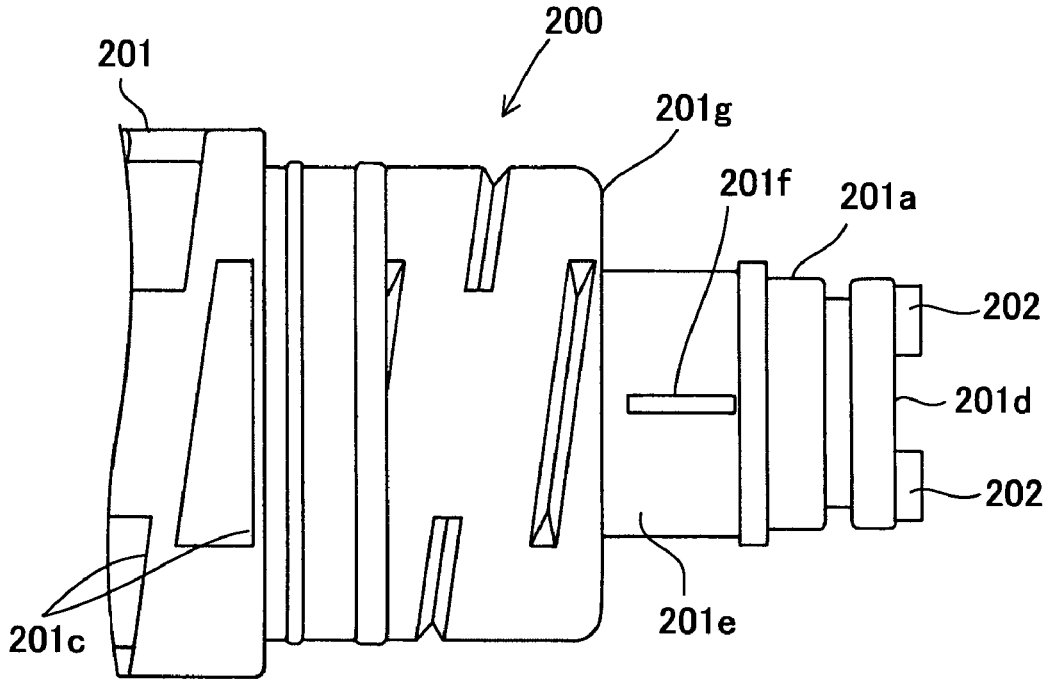
FIG. 8 is a side view of the front end part of a toner bottle as a part of the toner supply assembly.
Figure 9:
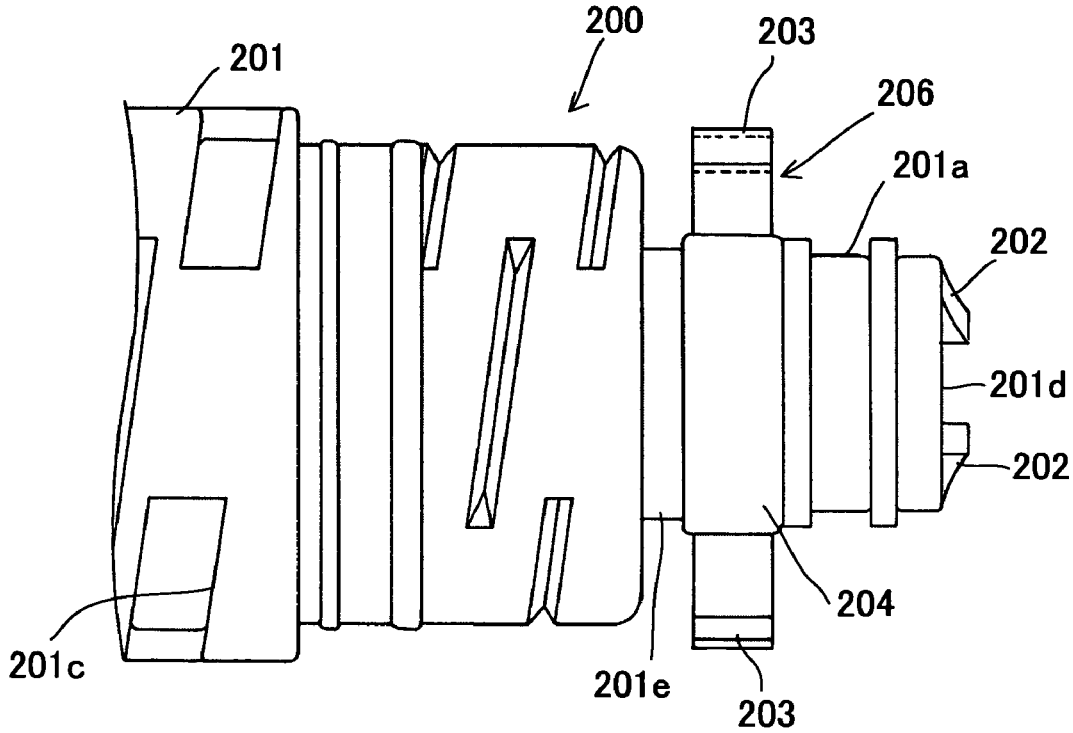
FIG. 9 is a side view showing a configuration when scrapers for toner conveyance are fitted to the front end part of the toner bottle.
Figure 10:
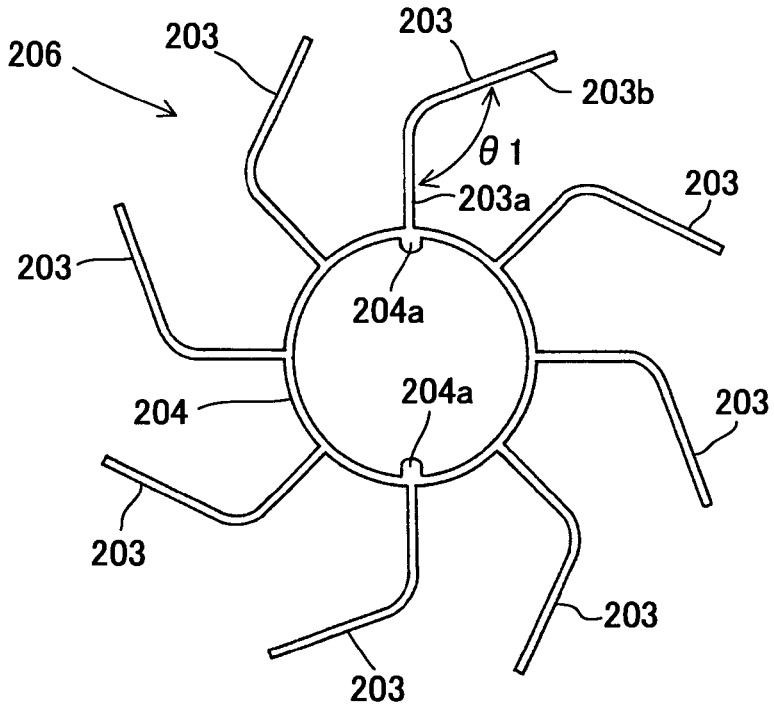
FIG. 10 is an illustrative view showing one example of the scrapers.
Figure 11:
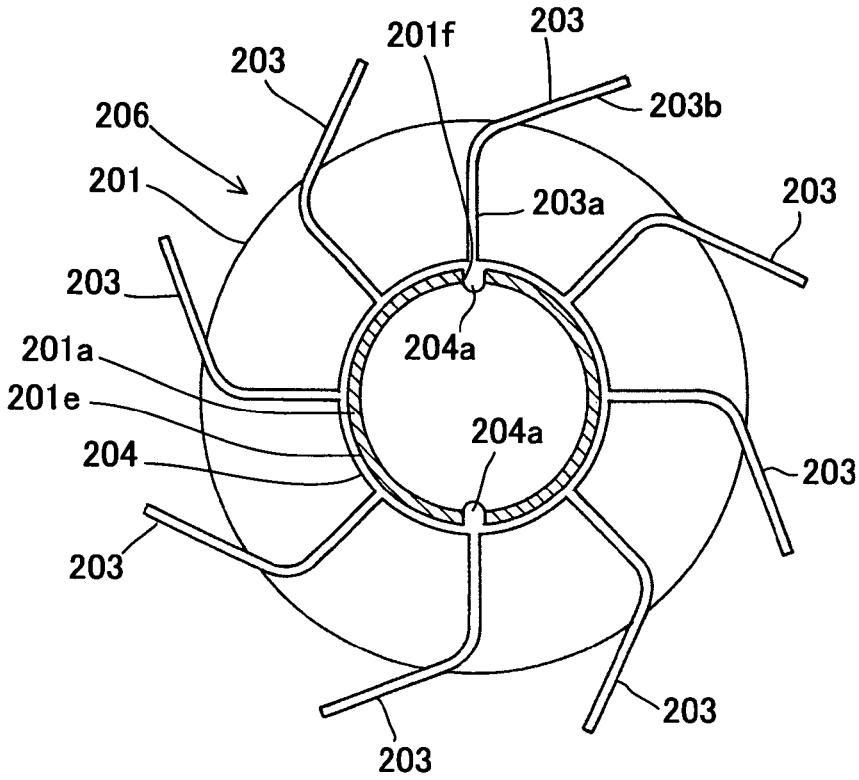
FIG. 11 is an illustrative view schematically showing a case where the scrapers are attached to the toner bottle.
Figure 12:
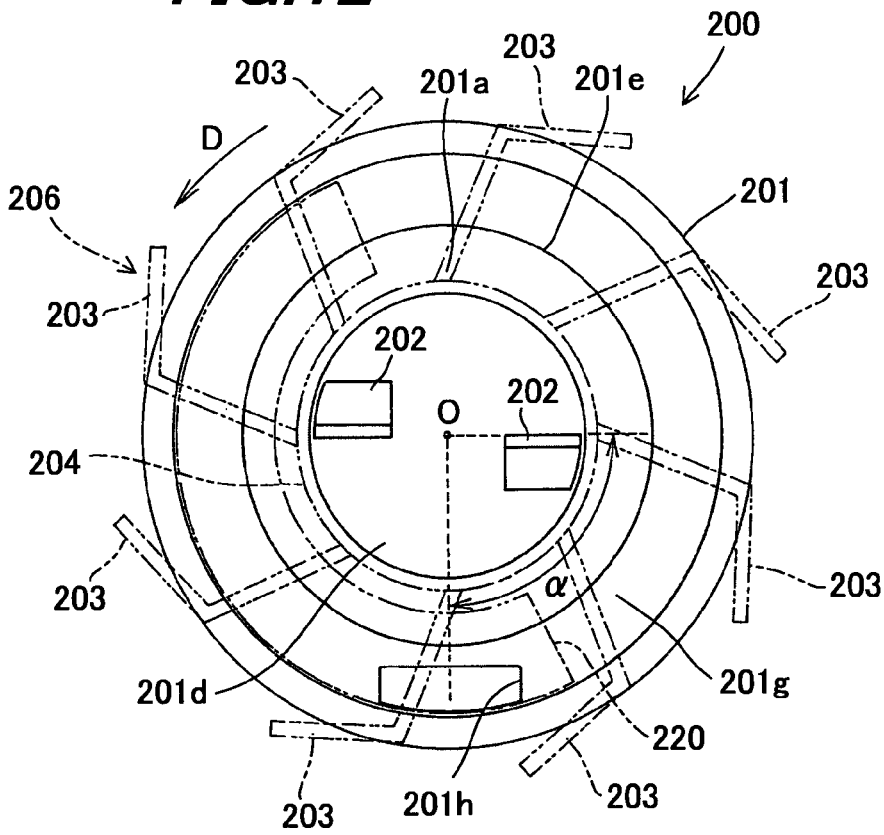
FIG. 12 is a front view showing a configuration of the toner bottle.

FIG. 7A is a side view showing a configuration of a toner supply assembly as a part of the toner supply device according to the present embodiment; FIG. 7B is a front view of the toner supply assembly, viewed from the end face side from which toner is supplied; FIG. 8 is a side view of the front end part of a toner bottle as a part of the toner supply assembly; FIG. 9 is a side view showing a configuration when scrapers for toner conveyance are fitted to the front end part of the toner bottle; FIG. 10 is an illustrative view showing one example of the scrapers; FIG. 11 is an illustrative view schematically showing a case where the scrapers shown in FIG. 10 are fitted to the toner bottle; and FIG. 12 is a front view showing a configuration of the toner bottle.

In the present embodiment, any of toner supply assemblies 500*a*, 500*b*, 500*c* and 500*d* for respective toner supply devices 100 (100*a*, 100*b*, 100*c* and 100*d*) mounted in image forming apparatus 1 is assumed to have an identical configuration.

As shown in FIGS. 2 and 7A, toner supply device 100 is mainly composed of a toner bottle (toner container) 200 that is filled with toner as a developer, a toner supply assembly 500 having a bottle holder (toner container holder) 300 that rotatably holds the toner bottle 200 at its one end, and a toner supply assembly mounting mechanism (toner feed device) 600 to which the toner supply assembly 500 is mounted so as to feed toner to developing unit 23.

Provided on the bottom of bottle holder 300 (the lower side when toner supply device 100 is mounted in image forming apparatus 1) is a shutter mechanism 400 for opening and closing an aftermentioned toner discharge port for discharging the toner fed from toner bottle 200 to the outside of bottle holder 300, as shown in FIG. 7B.

Illustratively, when the toner discharge port of bottle holder 300 is opened by shutter mechanism 400, the toner discharge port and supply passage part 612 as a part of toner supply assembly mounting mechanism 600 are connected to each other so that the toner supplied from toner bottle 200 is fed to developing unit 23 by way of supply passage part 612 that is connected to developing unit 23.

To begin with, toner bottle 200 which is the characteristic part in the present embodiment will be described.

As shown in FIG. 7A, toner bottle 200 is comprised of a main part (toner storing portion) 201 having an approximately cylindrical shape. When the end of main part 201 on the side supported by bottle holder 300 is called a front end part 201*a*, this front end part 201*a* is formed with an opening (described later) for discharging toner.

Formed on the peripheral side of main part 201 are a plurality of slots 201*c* which are depressed towards the rotational axis X. Here, on the interior side of main part 201, the parts corresponding to slots 201*c* form ribs that are projected towards the rotational axis X side.

The grooves formed between these ribs function as guide grooves for guiding the toner stored in main part 201 from rear end part 201*b* toward front end part 201*a*.

Herein, slots 201*c* are spirally formed as shown in FIG. 7A or inclined so that they move toward front end part 201*a* when main part 201 rotates about the rotational axis X clockwise viewed from the front end side (in the Y-direction). With this configuration, as toner bottle 200 rotates in the Y-direction, the toner held in the toner bottle 200 can be conveyed from rear end part 201*b* to front end part 201*a* of main part 201.

Here, slots 201*c* may have any shape as long as they can convey the toner stored in main part 201 from rear end part 201*b* toward front end part 201*a*.

As shown in FIG. 8, front end part 201*a* is formed to be a cylindrical shape having a smaller diameter than that of the central part of main part 201. A pair of ribs 202, 202 are projected outward from the front end face 201*d* of front end part 201*a*.

These ribs 202, 202 are adapted to be engaged with an actuator of an unillustrated drive when toner supply device 100 is mounted to image forming apparatus 1. With this arrangement, a drive force from the actuator is transferred by way of ribs 202 and 202 to toner bottle 200 of toner supply device 100 so that it is rotated.

As shown in FIGS. 9 and 10, peripheral surface 201*e* of front part end 201*a* is formed with a toner conveying means 206 which is constructed of a plurality of scrapers (toner conveyors) 203 for conveying toner and a fixing member (toner conveyor attachment) 204 on which scrapers 203 are integrally fixed.

Scrapers 203 are each formed of a plate-like elastic resin such as rubber etc, and arranged approximately radially outwards and equi-angularly at eight positions on the peripheral surface of fixing member 204, as shown in FIGS. 10 to 12. Each scraper 203 is formed in an inverted, approximately open-V section with its free end side bent to the upstream side (to the rear) with respect to the rotational direction (the direction indicated by arrow D in FIG. 12) of toner bottle 200.

In the present embodiment, the part of scraper 203, extending radially from fixing member 204 functions as a toner conveying portion 203*a* and the part that is flexed to the upstream side (rear side) with respect to the rotational direction of toner bottle 200 functions as a lid portion 203*b*.

Figure 21A:
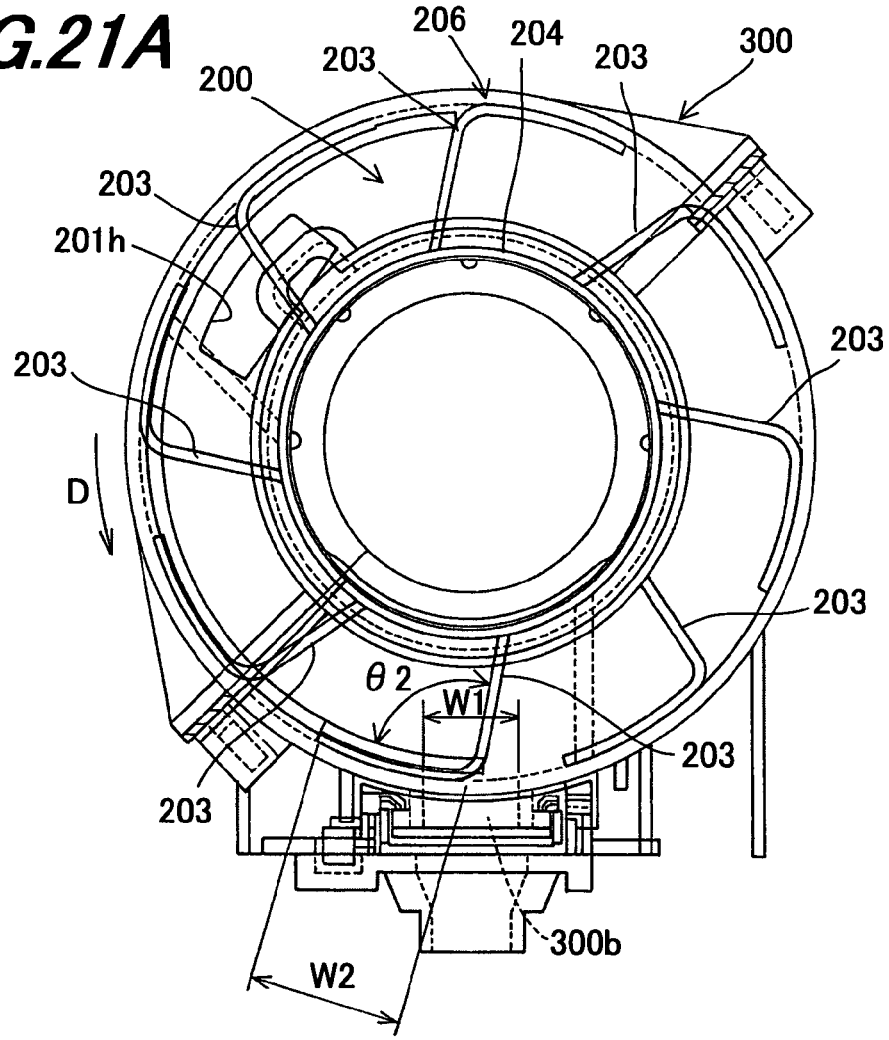
FIG. 21A is a front view showing a configuration of a bottle holder that constitutes the toner supply device.
Figure 21B:
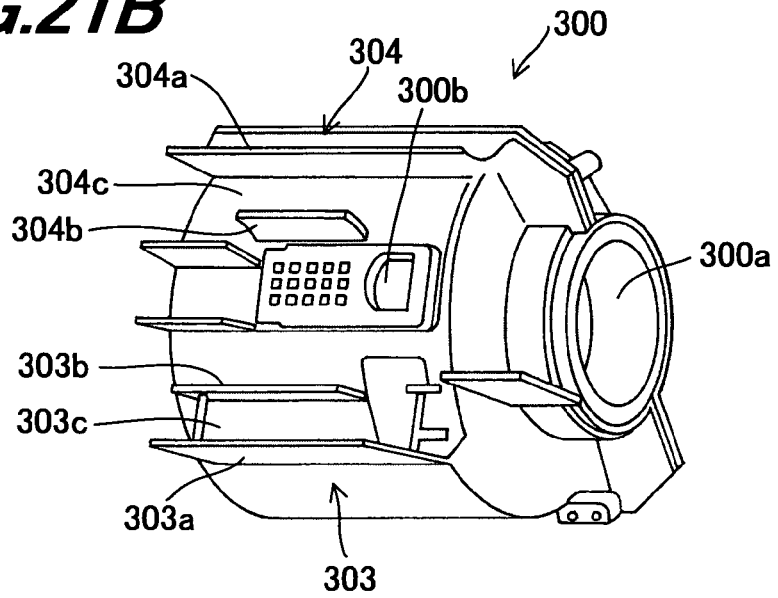
FIG. 21B is a perspective view showing the bottle holder, when it is viewed from the rear side.

Toner conveying portion 203*a* is formed longer than the size of the toner conveyance space in bottle holder 300, so that, when toner conveying means 206 fitted on toner bottle 200 is assembled inside bottle holder 300 and the toner bottle 200 is rotated the free end side of the scraper is tilted to the upstream side (rearwards) with respect to the toner bottle's direction of rotation (see FIGS. 21A and 21B).

This arrangement is aimed at scraping out the toner that is accumulated in toner discharge chamber 300*d* (FIG. 23) efficiently. However, if the length of toner conveying portion 203*a* of scraper 203 is too long, its friction with the inner peripheral surface of bottle holder 300 becomes greater, causing increase in rotational load. Accordingly, it is preferred that the length of the toner conveying portion is set at a size that will not cause sharp increase of the rotational load.

Lid portion 203*b* is formed so that the length W2 that comes into sliding contact with the inner peripheral surface of bottle holder 300 is longer than the opening length W1 of toner discharge port 300*b*. That is, lid portion 203*b* is constructed so as to completely cover the opening of toner discharge port 300*b* when it opposes toner discharge port 300*b* (see FIGS. 21A and 21B).

The opening angle between toner conveying portion 203*a* and lid portion 203*b* is set so that $\theta 1 > \theta 2$, where $\theta 1$ is the angle when scraper 203 shown in FIG. 10 is set free and $\theta 2$ is the angle when scraper 203 is assembled inside bottle holder 300 (FIG. 21A). The difference in opening angle makes it possible to bring lid portion 203*b* into close contact with toner discharge port 300*b* by the repulsive force of scraper 203.

As shown in FIG. 10, fixing member 204 has an annular shape, made up of a material having elasticity (a general elastic resin such as rubber etc.), having an inside diameter marginally smaller than the outside diameter of front end part 201*a* (FIG. 9) and being formed with projections 204*a* (FIG. 10) on the inner peripheral surface thereof.

These projections 204*a* are adapted to fit into cutouts 201*f* that are previously formed on the front end part 201*a*, as shown in FIG. 11.

In the present embodiment, use of this fixing member 204 makes it simple to arrange scrapers 203 on main part 201 by enlarging the ring part slightly and setting it on peripheral surface 201*e* (FIG. 8) of front end part 201*a*. Moreover, it is possible to reliably fix fixing member 204 to front end part 201*a* by fitting projections 204*a* of fixing member 204 into cutouts 201*f* formed on peripheral surface 201*e* of front end part 201*a*. That is, this arrangement enables fixing member 204 to be driven integrally with front end part 201*a* without it running idly over peripheral surface 201*e* of front end part 201*a*.

Here, scrapers 203 may be directly provided on peripheral surface 201*e* of front end part 201*a*.

Formed on an end face 201*g* that forms a step with front end part 201*a* in main part 201 is a bottle-side toner discharge port (toner discharge port) 201*h* for discharging the toner held in main part 201, as shown in FIG. 12.

Here, in the present embodiment, this bottle-side toner discharge port 201*h* is formed in an essentially rectangular shape, but the opening of the discharge port should not be limited to this and may have an approximately square-shaped, polygonal, circular or any other shaped configuration as long as it will not hinder discharge of toner.

Further, as shown in FIG. 12, scraper 203 is adjusted and positioned at a predetermined angle $\alpha$ with the center of bottle-side toner discharge port 201*h* when fixing member 204 is attached to the bottle.

Here, scrapers 203 are preferably disposed at positions so as not to disturb toner discharge from bottle-side toner discharge port 201*h*. As long as this condition is satisfied, any angle can be selected as angle $\alpha$. In order to reliably prevent failures of toner discharge from bottle-side toner discharge port 201*h*, angle $\alpha$ is preferably set at 90 deg.

The toner discharged from bottle-side toner discharge port 201*h* is collected inside bottle holder 300 that is provided so as to cover front end part 201*a*. Bottle holder 300 is formed with the toner discharge port for discharging the collected toner.

As shown in FIG. 12, bottle-side toner discharge port 201*h* is temporarily closed by a sealing element 220 until directly just before the operation of supplying toner to developing unit 23 is started as toner bottle 200 rotates.

Sealing element 220 is formed of a flexible material and is configured so that it peels off toner bottle 200 by rotation of the toner bottle 200 to thereby release bottle-side toner discharge port 201*h*.

Now, sealing element 220 will be described in detail with reference to the drawings.

Figure 13:
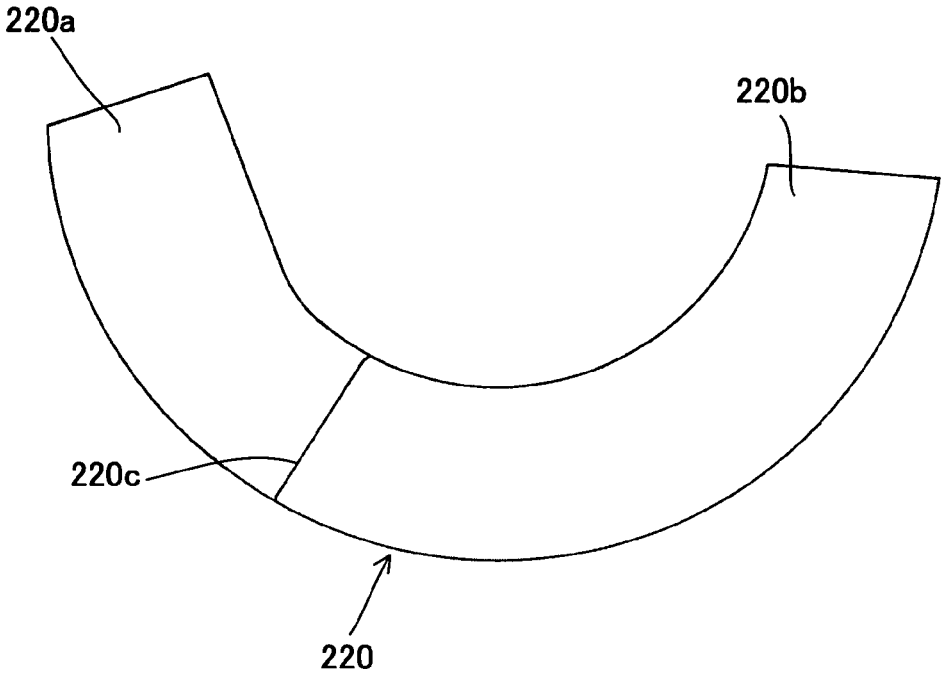
FIG. 13 is an illustrative view showing a configuration of a sealing element that closes a bottle-side toner discharge port of the toner bottle.
Figure 14A:
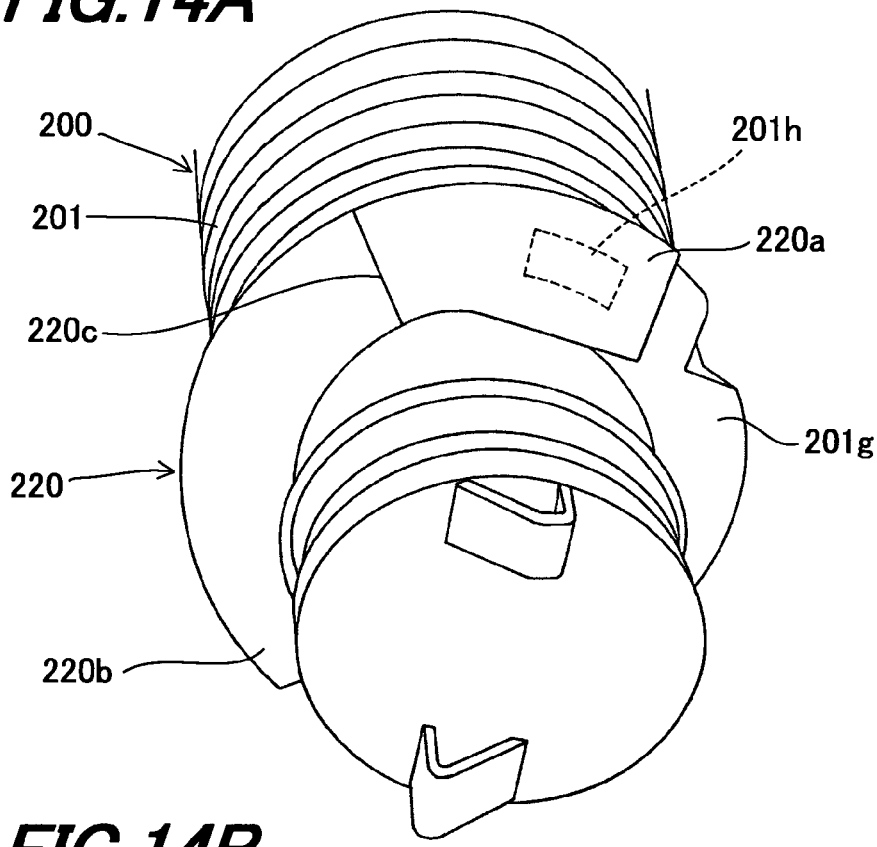
FIG. 14A is an illustrative view showing a state when the sealing element is fitted to the toner bottle.
Figure 14B:
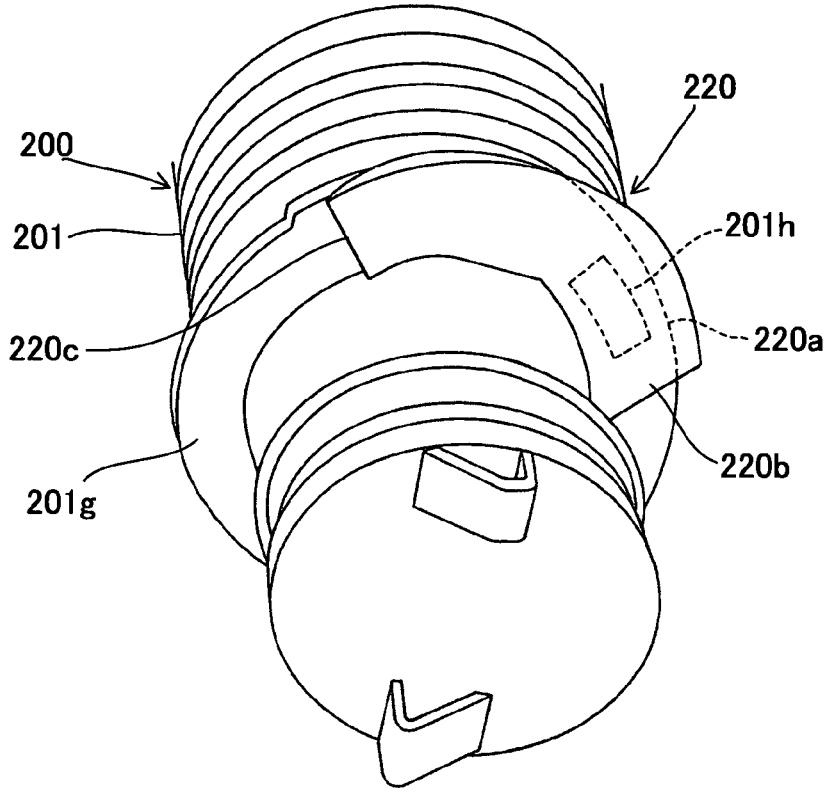
FIG. 14B is an illustrative view showing a state when the sealing element has been folded.
Figure 15:
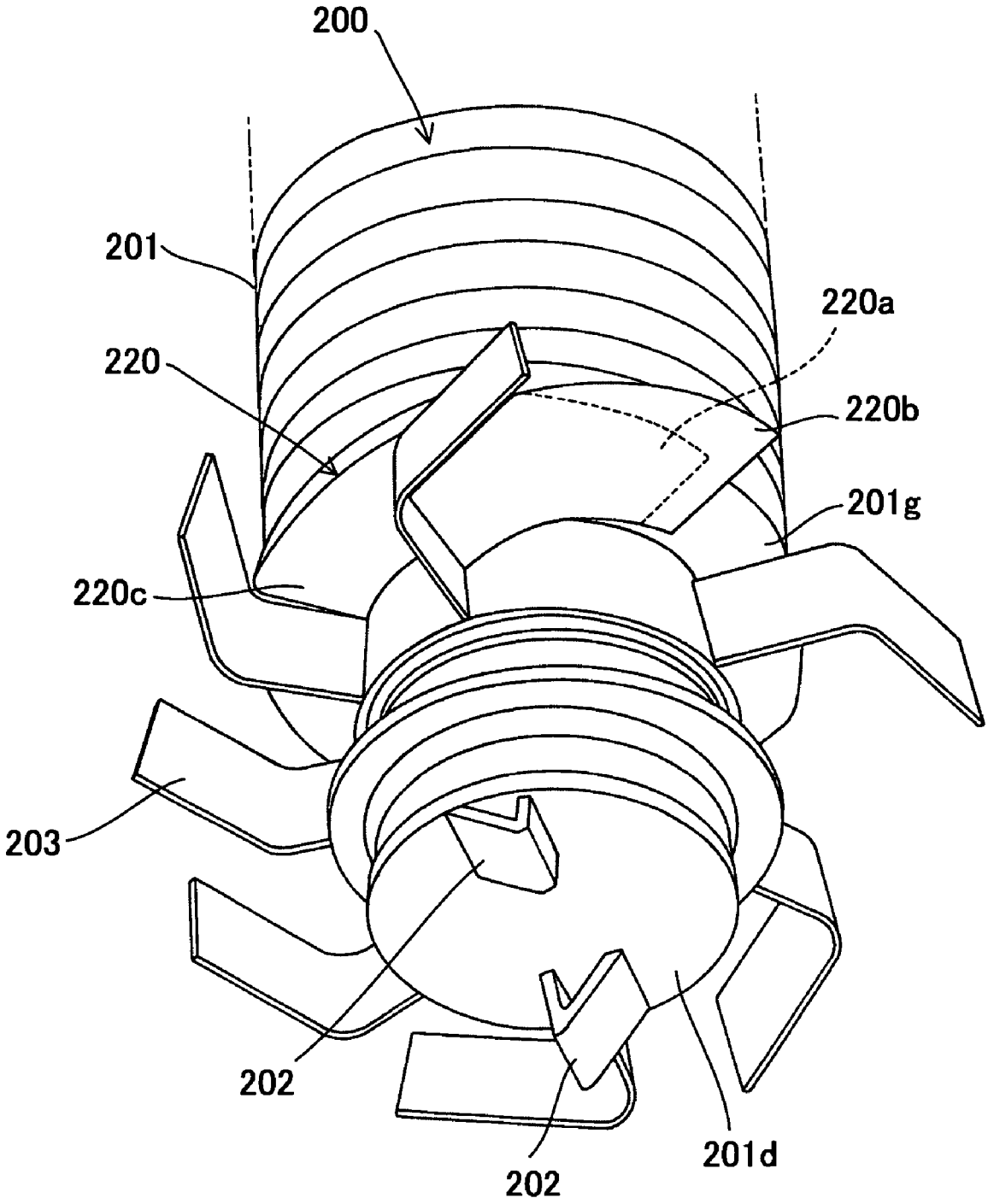
FIG. 15 is an illustrative view showing the positional relationship between the sealing element and scrapers.
Figure 16:
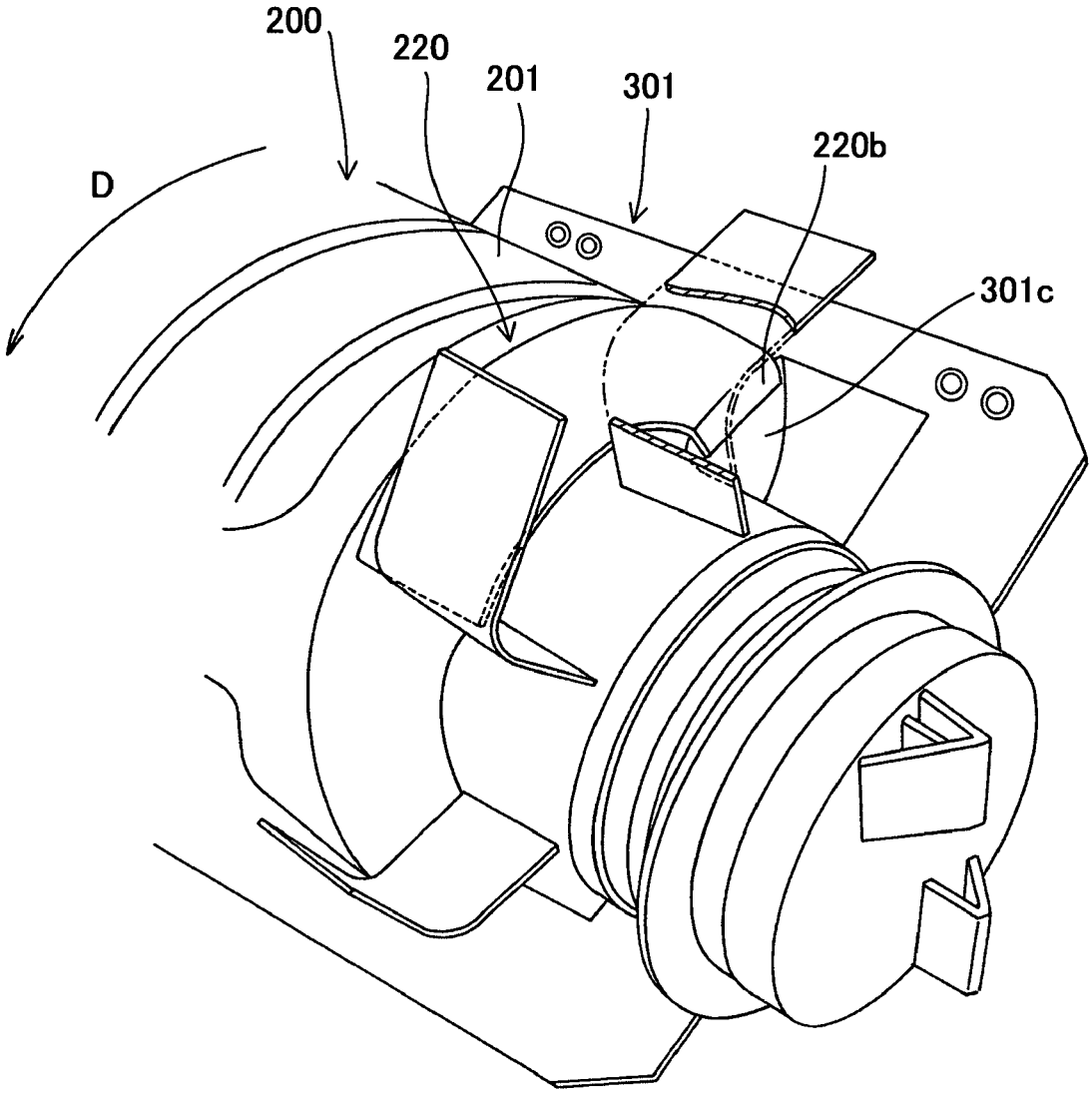
FIG. 16 is an illustrative view showing a state where the sealing element has been fitted to a bottle holder.

FIG. 13 is an illustrative view showing a configuration of the sealing element that closes the bottle-side toner discharge port of a toner bottle according to the present embodiment; FIG. 14A is an illustrative view showing a state when the sealing element is fitted to the toner bottle; FIG. 14B is an illustrative view showing a state when the sealing element has been folded; FIG. 15 is an illustrative view showing the positional relationship between the sealing element and scrapers; and, FIG. 16 is an illustrative view showing a state where the sealing element has been fitted to the bottle holder.

Sealing element 220 is formed of a product of DuPont Kabushiki Kaisha "Tyvek®", a felt made of extra fine polyethylene fibers, which is air-permeable and presents good slidability. The sealing element is, as shown in FIGS. 13 and 14A, is formed in an approximately arc shape having a predetermined width and covering an angular range of about 180 degrees along the toner bottle's peripheral direction over end face 201*g* of toner bottle 200 on which bottle-side toner discharge port 201*h* is formed.

As shown in FIG. 14A, sealing element 220 is arranged so that its first end 220*a* is bonded to end face 201*g* of toner bottle 200 so as to cover and seal bottle-side toner discharge port 201*h* while second end 220*b* is bonded to an aftermentioned wall portion 301*c* (FIGS. 16 and 22A) formed inside bottle holder 300.

Further, as shown in FIG. 14B, sealing element 220 is laid out between end face 201*g* and scrapers 203 as shown in FIG. 15 and folded at the approximate center of the arc over end face 201*g* of toner bottle 200 so that its fold 220*c* is located on the downstream side (front side) of the folded second end 220*b* with respect to the toner bottle's direction of rotation.

Also, as shown in FIGS. 14 and 16, bottle-side toner discharge port 201*h* that is hermetically closed by sealing element 220 is set at such a position as to oppose wall portion (inner wall portion) 301*c* of bottle holder 300, so that toner bottle 200 is positioned and held temporarily by the sealing element 220.

In the present embodiment, toner bottle 200 to which sealing element 220 is bonded is adapted to be fixed when this sealing element 220 is fixed to bottle holder 300.

With this arrangement, since sealing element 220 is disposed opposing wall portion 301*c* of bottle holder 300, if a pressure due to falling toner acts on sealing element 220 of bottle-side toner discharge port 201*h* when toner is charged into main part 201 of toner bottle 200, the toner's pressure can be received by wall portion 301*c*. As a result it is possible to perform toner loading without making sealing element 220 peel off.

Sealing element 220's first end 220*a* that is bonded to the toner bottle 200 side is adhered to toner bottle 200's end face 201*g* by thermal fusing heat seal while second end 220*b* that is bonded to the bottle holder 300 side is adhered to wall portion 301*c* of bottle holder 300 with an adhesive such as double-sided tape. The adhesive strength with which second end 220*b* is adhered to the bottle holder 300 side is specified to be greater than the adhesive strength with which first end 220*a* is adhered to the toner bottle 200 side.

Second end 220*b* of sealing element 220 is fixed to bottle holder 300 by making an acute angle to the wall portion 301*c*, as shown in FIG. 16.

With this arrangement, when sealing element 220 is peeled off by rotation of toner bottle 200, toner bottle 200 turns in the direction of arrow D and second end 220*b* of sealing element 220 is pulled in the direction along the wall portion 301*c*, thus second end 220*b* is adapted to be unlikely peeled off wall portion 301*c*.

On the other hand, since first end 220*a* of sealing element 220 is pulled in the direction approximately 180 degrees opposite to end face 201*g* of toner bottle 200, first end 220*a* is easy to be peeled off end face 201*g*.

With the above operation, since first end 220*a* can be easily peeled off end face 201*g* of toner bottle 200 while second end 220*b* that is bonded to wall portion 301*c* of bottle holder 300 will not come off, it is possible to simply open bottle-side toner discharge port 201*h* as toner bottle 200 is rotated.

Further, since sealing element 220, after it has been separated from toner bottle 200, remains bonded and fixed at its second end 220*b* to wall portion 301*c* of bottle holder 300, the sealing element is adapted to stay in the interior space enclosed by bottle holder 300.

As another characteristic configuration of toner bottle 200, a toner loading portion for loading toner into main part 201 is arranged at rear end part 201*b* of toner bottle 200.

Now, the configuration of rear end part 201*b* of toner bottle 200 will be described in detail with reference to the drawings.

Figure 17:
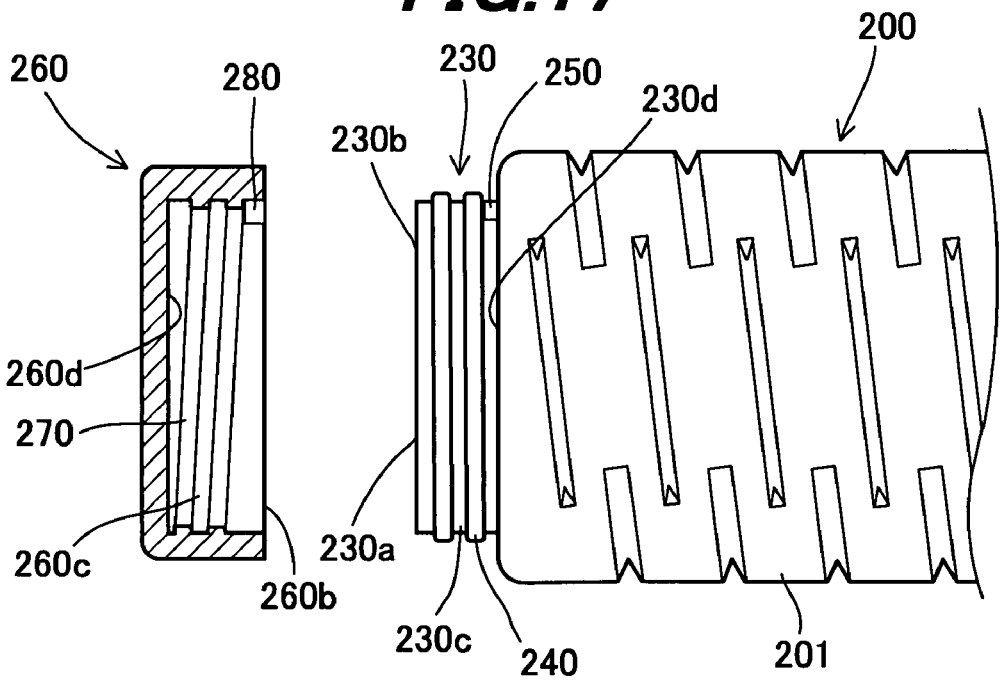
FIG. 17 is an illustrative view showing a configuration of the rear end part of the toner bottle and a bottle cap.
Figure 18:
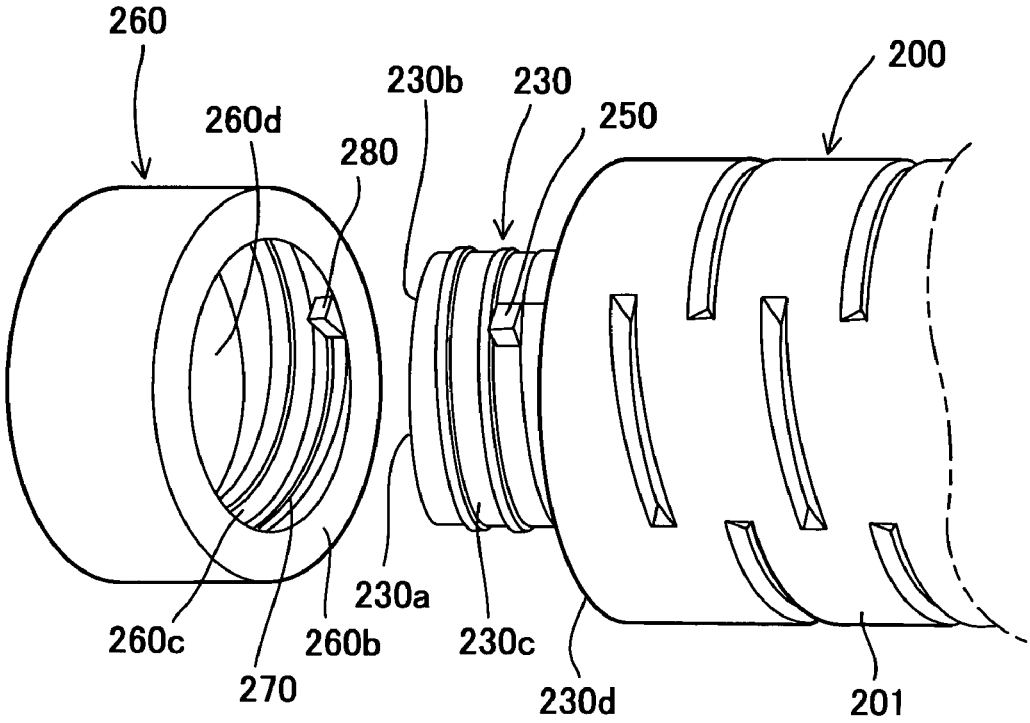
FIG. 18 is a perspective view showing a configuration of the rear end part of the toner bottle and a bottle cap.
Figure 19A:
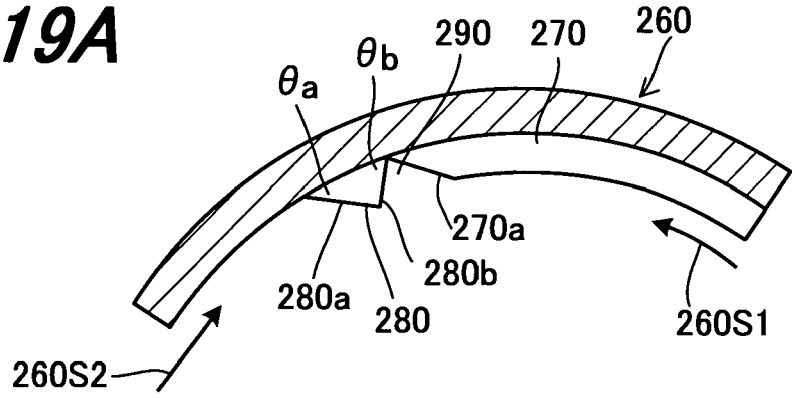
FIG. 19A is a partial detailed view showing a structure of the engagement portion of the bottle cap with a toner loading portion.
Figure 19B:
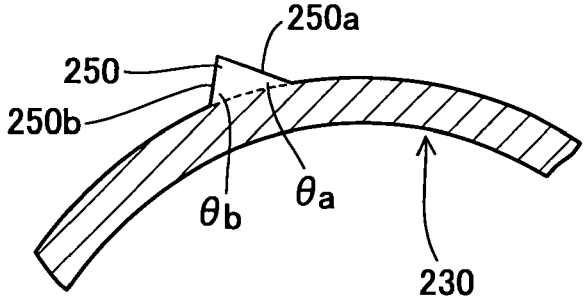
FIG. 19B is a partial detailed view showing a structure of the engagement portion of the toner loading portion with the bottle cap.
Figure 20:
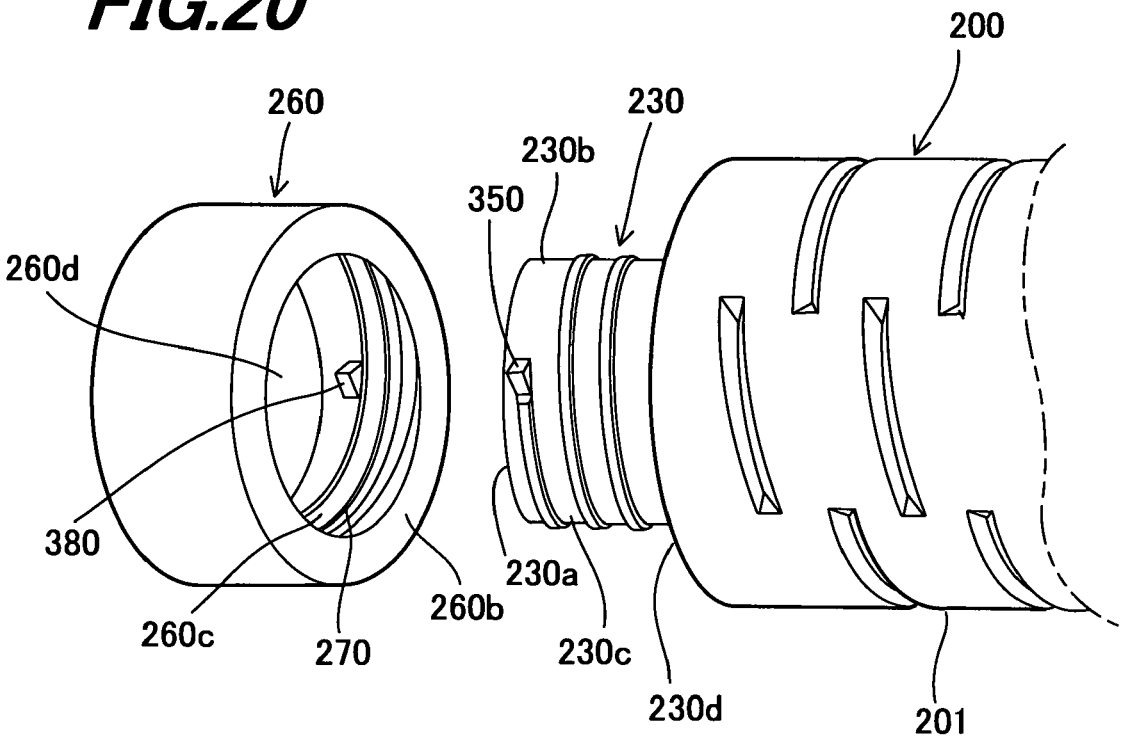
FIG. 20 is a perspective view showing another configurational example of the engagement portion between the toner bottle and bottle cap.

FIG. 17 is an illustrative view showing a configuration of the rear end part of the toner bottle and a bottle cap according to the present embodiment; FIG. 18 is an perspective view showing a configuration of the rear end part of the toner bottle and the bottle cap; FIG. 19A is a partial detailed view showing a structure of the engagement portion of the bottle cap with a toner loading portion; FIG. 19B is a partial detailed view showing a structure of the engagement portion of the toner loading portion with the bottle cap; and FIG. 20 is a perspective view showing another configurational example of the engagement portion between the toner bottle and a bottle cap.

In toner bottle 200 (FIG. 7*a*), a toner loading portion 230 having a toner loading opening 230*a* (FIG. 17) for loading toner into main part 201 is projectively formed in main part 201's rear end part 201*b* that is located on the side opposite to front end part 201*a*. A bottle cap (cap element) 260 (FIG. 17) that can seal and open this toner loading opening 230*a* is detachably provided for toner loading portion 230. This toner loading portion 230 and bottle cap 260 are constructed so as to detachably join to each other by screw joint.

As shown in FIGS. 17 and 18, toner loading portion 230 is formed projectively to the rear in the longitudinal direction of toner bottle 200 with toner loading opening 230*a* formed at its front end 230*b* and a threaded portion (male thread) 240 formed on its outer periphery 230*c*.

Further, a cap locking projection (second projection) 250 is projectively formed near the terminal of threaded portion 240 in the vicinity of the proximal part, designated at 230*d*, of toner loading portion 230.

On the other hand, bottle cap 260 is constructed so as to enclose toner loading opening 230*a* and outer periphery 230*c* of toner loading portion 230. Formed on the bottle cap 260's inner periphery, designated at 260*c*, which opposes the outer periphery 230*c*, is a threaded portion (female thread) 270 to mate threaded portion 240 of toner loading portion 230. Further, a locking projection (first projection) 280 is projectively formed near the screw-starting end of threaded portion 270 in the vicinity of the opening side end, designated at 260*b*, of bottle cap 260.

As seen in FIG. 5, bottle cap 260 also incorporates an IC chip (electric recording medium) 261 with the number of times of recycling, ID information on the toner being filled and the like recorded therein, so that information on toner bottle 200 can be read by image forming apparatus 1 when the toner bottle is set therein.

Here, locking projection 280 of bottle cap 260 and locking projection 250 of toner loading portion 230 will be described in detail with reference to the drawings.

FIG. 19A is a partial detailed view showing the structure of the locking projection of the bottle cap of the toner bottle according to the present embodiment and FIG. 19B is a partial detailed view showing the structure of the cap locking projection of the toner loading portion of the toner bottle.

As shown in FIGS. 19A and 19B, locking projection 280 of bottle cap 260 and cap locking projection 250 of toner loading portion 230 have triangular sections approximately similar to each other, so that locking projection 280 and cap locking projection 250 will mesh each other when toner loading opening 230*a* is sealed properly by bottle cap 260 by fastening bottle cap 260 by screw-fitting onto toner loading portion 230.

As shown in FIG. 19A, locking projection 280 of bottle cap 260 is formed of a first slope 280*a* on the upstream side with respect to the direction in which bottle cap 260 is fastened and a second slope 280*b* on the downstream side.

The inclination angle θa of first slope 280*a* is formed to be more acute than the inclination angle θb of second slope 280*b*. In other words, first slope 280*a* is formed to be more gentle than second slope 280*b*.

On the other hand, as shown in FIG. 19B, cap locking projection 250 is formed of a first slope 250*a* on the upstream side with respect to the direction in which toner loading portion 230 is fastened and a second slope 250*b* on the downstream side.

The inclination angle θa of first slope 250*a* is formed to be more acute than the inclination angle θb of second slope 250*b*. In other words, first slope 250*a* is formed to be more gentle than second slope 250*b*.

Provided further in the threaded portion 270's screw starting end where locking projection 280 is formed is a recess 290 that is recessed approximately similarly to the shape of cap locking projection 250 and contiguously from locking projection 280.

When toner loading portion 230 and bottle cap 260 are fastened to each other, this recess 290 becomes engaged with cap locking projection 250 and set into a condition of being locked.

Here, in the present embodiment, cap locking projection 250 is formed near the terminal end of threaded portion 240 in proximal part 230*d* of toner loading portion 230 and locking projection 280 is formed near the screw starting end of threaded portion 270 of opening-side end 260*b* of bottle cap 260. However, the positions where the projections are formed are not particularly limited.

For example, as a variational example, as shown in FIG. 20, a cap locking projection 350 may be formed near the screw starting end of threaded portion 240 of front end 230*b* of toner loading portion 230 while a locking projection 380 is formed near the threaded portion 270's terminal end in the bottom, designated at 260*d* of bottle cap 260.

Also, the shapes of the aforementioned projections are not limited to those having triangular sections, but the projections also may have arced sections as long as they can establish a locked condition.

Next, bottle holder 300 will be described in detail with reference to the drawings.

Figure 22A:
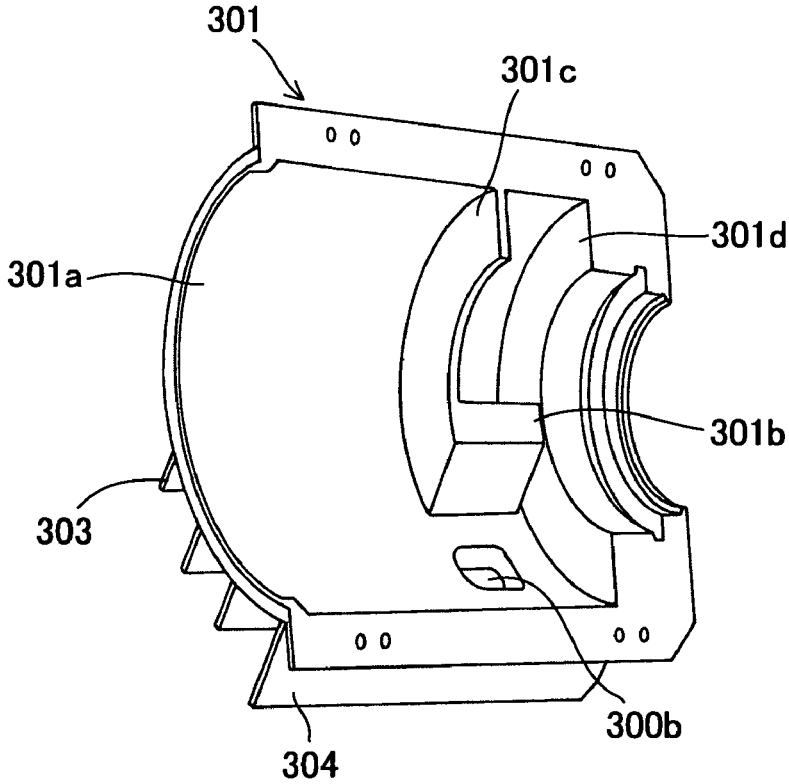
FIG. 22A is a perspective view showing a first casing that constitutes the bottle holder.
Figure 22B:
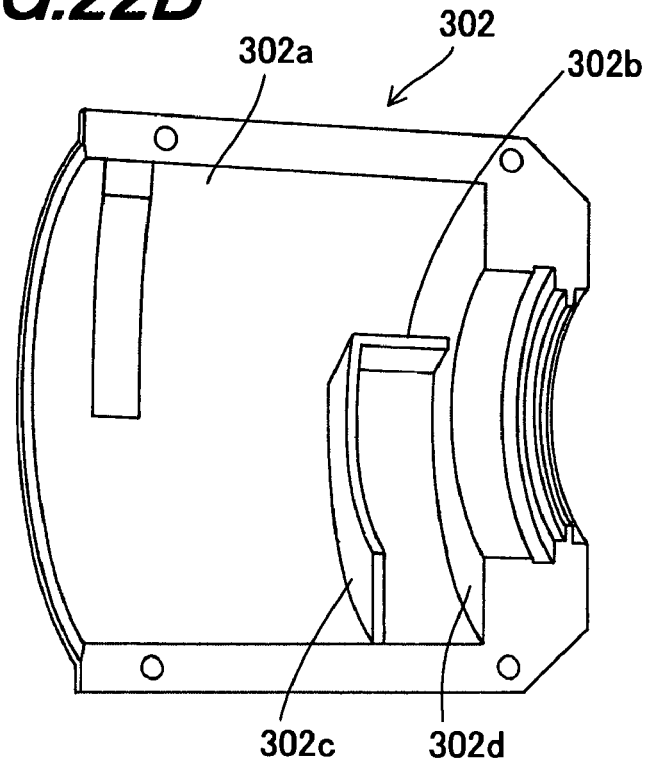
FIG. 22B is a perspective view showing a second casing that constitutes the bottle holder.
Figure 23:
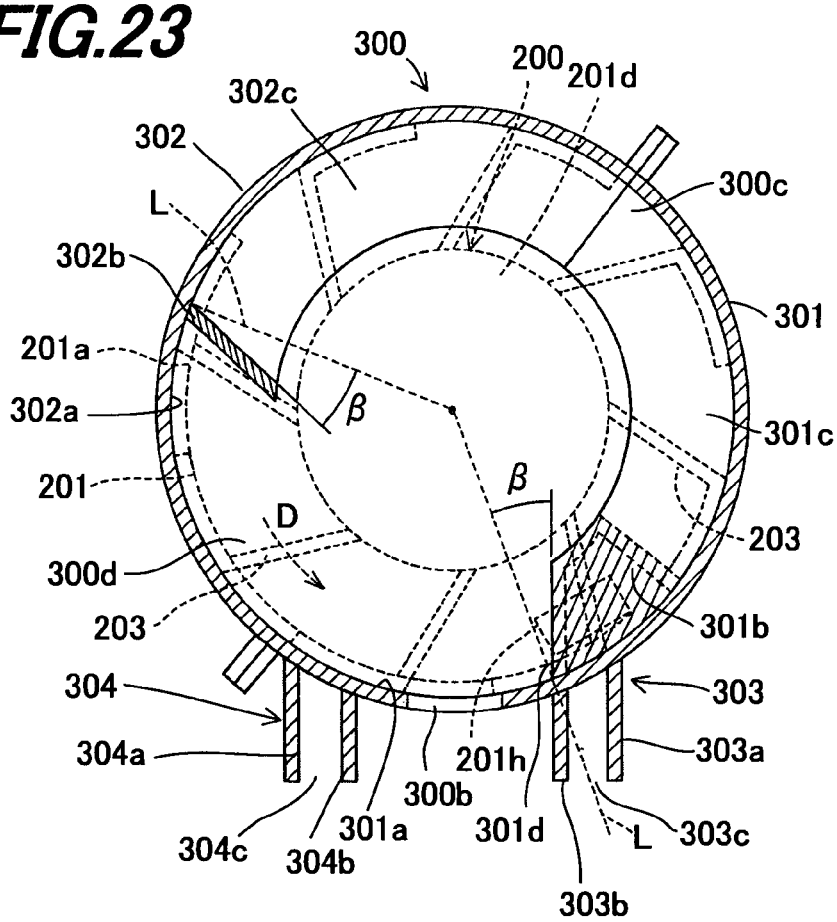
FIG. 23 is an illustrative view showing a positional relationship between a toner discharge chamber of the bottle holder and toner bottle's scrapers.
Figure 24:
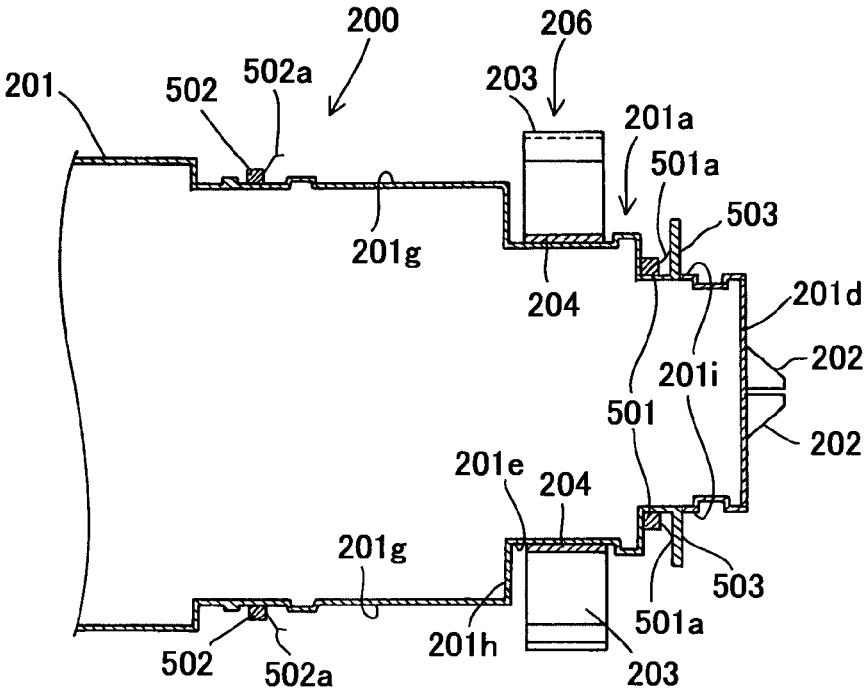
FIG. 24 is a schematic sectional view showing a configuration of the front end part of the toner bottle.

FIG. 21A is a front view showing a configuration of a bottle holder that constitutes a toner supply device according to the present embodiment; FIG. 21B is a perspective view showing the bottle holder, when it is viewed from the rear side; FIG. 22A is a perspective view showing a first casing that constitutes the bottle holder; FIG. 22B is a perspective view showing a second casing that constitutes the bottle holder; FIG. 23 is an illustrative view showing a positional relationship between a toner discharge chamber of the bottle holder and scrapers of the toner bottle; and FIG. 24 is a schematic sectional view showing a configuration of the front end part of the toner bottle.

As shown in FIGS. 7A and 7B, bottle holder 300 has an approximately cylindrical configuration, and is composed of a first casing 301 and second casing 302, joined to each other so as to cover front end part 201*a* of main part 201. At the end of the bottle holder 300 an opening 300*a* is formed so as to expose at least ribs 202 which are disposed at front end face 201*d* of front end part 201*a*.

Formed on the exterior of first casing 301 are a pair of plate-like first and second fixing structures (guide portions) 303 and 304 arranged parallel to each other, for fixing toner supply device 100 to image forming apparatus 1. Shutter mechanism 400 for controlling discharge of the toner fed from toner supply device 100 to the outside is arranged between these first and second fixing structures 303 and 304.

Accordingly, in order to make shutter mechanism 400 function correctly, the heights of first and second fixing structures 303 and 304 are adjusted so as to assure a clearance between bottle holder 300 and image forming apparatus 1.

Further, in first fixing structure 303, a pair of rib pieces 303*a* and 303*b* are arranged a predetermined distance apart from one another, forming a guide portion 303*c* extending in the axial direction of toner bottle 200. Also in second fixing structure 304, a pair of rib pieces 304*a* and 304*b* are arranged similarly, forming a guide portion 304*c* along the axial direction.

As shown in FIGS. 21A and 21B, bottle holder 300 has toner discharge port 300*b* formed on the bottom side of first casing 301 between first fixing structure 303 and second fixing structure 304. This toner discharge port 300*b* is adapted to be opened and closed by shutter mechanism 400.

As shown in FIG. 22A, in first casing 301, a first dam portion 301*b* for holding back the toner is formed on the inner peripheral surface, designated at 301*a* near the aforementioned toner discharge port 300*b* and a wall portion 301*c* is extended from this first dam portion 301*b* toward the side opposite to toner discharge port 300*b*. This wall portion 301*c* is arranged a predetermined distance apart from one end face or abutment surface 301*d* inside first casing 301. This distance is specified to be marginally greater than the width of the aforementioned scrapers 203.

Similarly to the first casing 301, second casing 302 is constructed as shown in FIG. 22B so that a second dam portion 302*b* for holding back the toner is formed on the inner peripheral surface, designated at 302*a* and a wall portion 302*c* is extended from this second dam portion 302*b*. This wall portion 302*c* is arranged a predetermined distance apart from one end face or abutment surface 302*d* inside second casing 302. This distance is specified to be marginally greater than the width of the aforementioned scrapers 203.

Joining first casing 301 and second casing 302 constitute the bottle holder 300 as shown in FIG. 21B.

When first casing 301 and second casing 302 are joined, a first space 300*c* is defined by enclosure of first dam portion 301*b* of first casing 301, second dam portion 302*b* of second casing 302, wall portions 301*c* and 302*c*, as shown in FIG. 23.

In the present embodiment, this first space 300*c* is referred to as a toner discharge control chamber for limiting discharge of toner, while the space (second space) other than the first space, between first dam portion 301*b* and second dam portion 302*b*, is designated at 300*d* and referred to as a toner discharge chamber, which functions to discharge the toner from toner bottle 200 after its temporal storage.

Toner discharge control chamber 300*c* is not a space from which toner is actually discharged, but functions as a space for allowing scraper 203 that has come over first dam portion 301*b* to pass therethrough. In this case, though some toner which has ridden over first dam portion 301*b* with scrapers 203 exists in toner discharge control chamber 300*c*, this toner will be scraped out from the second dam portion 302*b* side by rotational movement of scrapers 203.

On the other hand, toner discharge chamber 300*d* functions as a space for temporarily storing the toner discharged from bottle-side toner discharge port 201*h* of toner bottle 200.

Here, first dam portion 301*b*'s abutment 301*d* with scraper 203 is inclined in the rotational direction of scraper 203 (in the direction of the arrow in the drawing) as shown in FIG. 23 so that scraper 203 can ride over it properly. That is, abutment surface 301*d* is inclined so that it goes away in the rotational direction of scraper 203 from a normal L from rotational center O of toner bottle 200.

In other words, first dam portion 301*b* is disposed on the upstream side of the scraper 203's direction of toner conveyance, and first dam portion 301*b*'s abutment surface 301*d* with scraper 203 is arranged as a slope forming a predetermined angle β with normal L from the rotational center O, to thereby define toner discharge chamber 300*d*. This angle β is determined as appropriate depending on the scraper 203's material, length and other factors.

As another feature, first dam portion 301*b* is disposed slightly away from toner discharge port 300*b* in the scraper 203's rotational direction. This arrangement enables easy accommodation of toner in toner discharge chamber 300*d*. In this way, by making toner easily be stored in toner discharge chamber 300*d*, it is possible to keep constant the amount of toner supply to be discharged through toner discharge port 300*b*. Thus, it is possible to realize stable toner supply.

Similarly to first dam portion 301*b*, second dam portion 302*b* is formed so that its abutment surface 302*d* with scraper 203 (the surface on the toner discharge control chamber 300*c* side) is arranged as a slope forming a predetermined angle β with normal L from the rotational center O, to thereby define toner discharge chamber 300*d*. This angle β is determined as appropriate, depending on the scraper 203's material, length and other factors.

In connection to the above, the distance between first dam portion 301*b* and second dam portion 302*b* on the toner discharge chamber 300*d* side should at least have a distance that will not close toner discharge port 300*b*. Since it is necessary to accumulate a certain amount of toner in toner discharge chamber 300*d* from a viewpoint of stable toner supply, the distance should be specified as appropriate in accordance with the desired amount of toner being stored.

In addition, though the aforementioned scraper 203 was mentioned to have a plate-like configuration it should not be limited to this. For example, the scraper may have an approximately V-shaped cross-section. If scraper 203 has an approximately V-shaped cross-section, it can provide sealing function of sealing between the inner peripheral surface of bottle holder 300 and toner bottle 200, hence no separate sealing member is needed.

In accordance with the toner supply assembly 500 thus constructed, since toner bottle 200 is rotatably supported by bottle holder 300, there must be a certain amount of clearance between toner bottle 200 and bottle holder 300. To deal with this, in the present embodiment, two V-rings 501 and 502 for providing a sealing function are attached on front end part 201*a* of main part 201 of toner bottle 200, as shown in FIG. 24.

V-ring 501 is fitted on a peripheral surface 201*i* of front end part 201*a* at a position outside the position where scrapers 203 are fixed, while V-ring 502 is fitted at the end surface, designated at 201*g*, of front end part 201*a* at a position inside the position where scrapers 203 are fixed.

Arranged further outside of the position where V-ring 501 is fitted is a slip ring 503 of a plate-like annular member for creating clearance between toner bottle 200 and bottle holder 300 and allowing toner bottle 200 to rotate smoothly.

V-ring 501 is attached to main part 201 with its sealing flange 501*a* pressed against slip ring 503, while V-ring 502 is attached to main part 201 with its sealing flange 502*a* pressed against the inner peripheral surface (described later) of bottle holder 300. In this way, these two V-rings 501 and 502 provide sealing function.

Slip ring 503 is fitted rotatably on peripheral surface 201*i* of front end part 201*a* of main part 201 and is adapted to be fixed to the inner peripheral surface of bottle holder 300 when toner bottle 200 is attached to bottle holder 300.

With this arrangement, slip ring 503 can be fixed to the bottle holder 300 side, so that main part 201 of toner bottle 200 will rotate along the inner peripheral surface of the slip ring 503.

Now, one example of slip ring 503 will be described with reference to the drawings.

Figure 25:
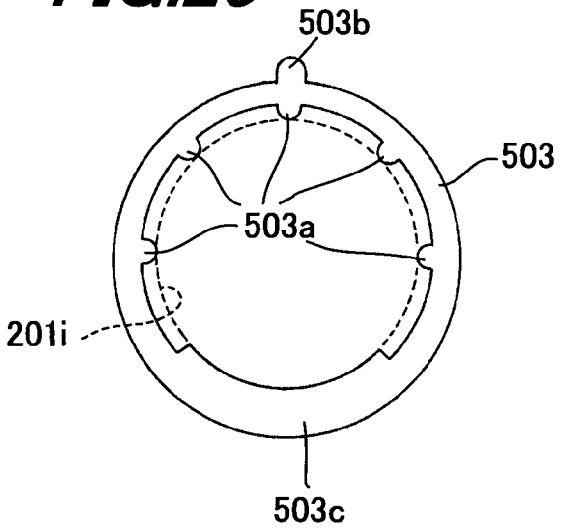
FIG. 25 is a plan view showing a configuration of a slip ring of the toner bottle.
Figure 26:
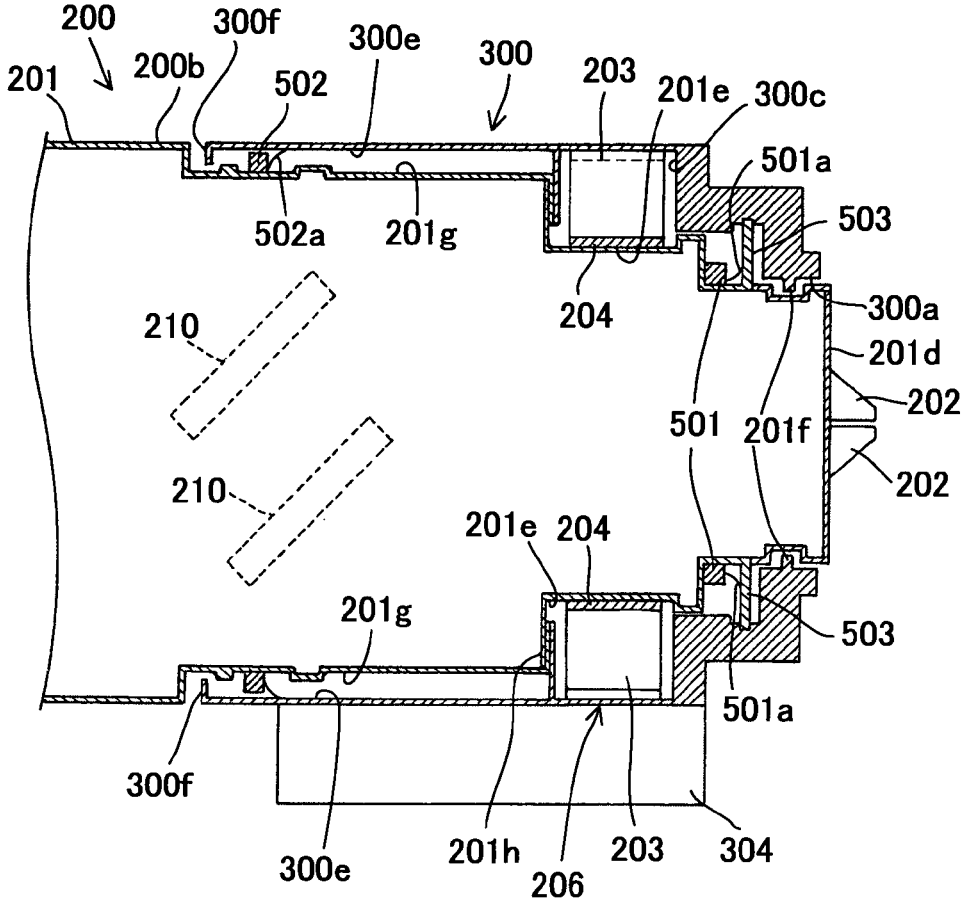
FIG. 26 is a schematic sectional view showing the bottle holder attached to the front end part of the toner bottle.

FIG. 25 is a plan view showing a configuration of the slip ring of a toner bottle as a part of the toner supply device according to the present embodiment, and FIG. 26 is a schematic sectional view showing the bottle holder attached to the front end part of the toner bottle.

As shown in FIG. 25, slip ring 503 is configured so that its inner periphery is formed with a plurality of projections 503*a* that will come into point contact with the fitted surface, i.e., peripheral surface 201*i*, in front end part 201*a* of main part 201 and an essentially arced supporting portion 503*c* that has the same curvature as the peripheral surface 201*i* and hence comes into line contact with peripheral surface 201*i* while a projection 503*b* is formed at the top of the outer peripheral surface. This projection 503*b* is fitted into an unillustrated cutout formed on the inner peripheral surface of bottle holder 300.

Since, in general, slip ring 503 and main part 201 of toner bottle 200 are adapted to slide along each other, it is possible to rotate toner bottle 200 smoothly without load if friction therebetween is minimized.

Accordingly, provision of multiple projections 503*a* that come into point contact with peripheral surface 201*i* (FIG. 24) on the inner peripheral surface of slip ring 503 as shown in FIG. 25 reduces the total contact area between toner bottle 200 and slip ring 503, hence making it possible to reduce friction between slip ring 503 and main part 201 of toner bottle 200. In this way, it is possible to reduce the rotational load which arises due to increase in friction, and hence rotate toner bottle 200 smoothly inside slip ring 503.

It is noted that the shape of slip ring 503 should not be limited to the configuration shown in FIG. 25, but slip ring 503 may have a shape that supports toner bottle 200 at pointed contacts, such as a polygonal shape, for example.

In sum, plate-like slip ring 503 has, on its inner periphery, an arc of line-contact projection 503*c*, which ranges in a predetermined angle and is margined with a predetermined clearance over peripheral surface 201*i* of toner bottle 200 and the remaining arc having a greater radius with multiple projections 503*a* projected inwards in parts therefrom.

With this configuration, the bottle can be supported by arced area at its bottom where the bottle weight acts thereon to prevent abrasion while the other part is supported by essentially pointed contacts, of multiple projections arranged at intervals of a predetermined distance or, of a polygonal shape, whereby it is possible to reduce the sliding load.

Further, since sealing flange 501*a* (FIG. 24) of V-ring 501 is adapted to abut this slip ring 503, it is possible to reliably prevent toner from leaking downward (in the direction of gravity) in bottle holder 300.

Also, V-ring 502 is attached to front end part 201*a* as shown in FIG. 26 so that its sealing flange 502*a* comes into pressing contact with inner peripheral surface 300*e* of bottle holder 300 when front end part 201*a* of main part 201 of toner bottle 200 is supported by bottle holder 300. This construction makes it possible to prevent toner leakage from the rear end 300*f* side of bottle holder 300.

It should be noted that the joint between first casing 301 and second casing 302 is properly sealed.

As described above, any portion of bottle holder 300 which is likely to cause toner leakage is completely sealed.

Further, formed on the peripheral surface of front end part 201*a* of main part 201 of toner bottle 200 are a plurality of plate-like ribs 210 made of elastic resin etc., and arranged obliquely in parallel to each other, as shown in FIG. 26, so that these ribs 210 will come into press-contact with inner peripheral surface 300*e* of bottle holder 300 when toner bottle 200 is held by bottle holder 300. With this arrangement, it is possible to push out the toner that has entered the gap between toner bottle 200 and bottle holder 300 as these ribs 210 rotate.

As described, bottle holder 300 is composed of two separate casings, namely first and second casings 301 and 302, being joined together. When these first and second casings 301 and 302 are detachably joined, it is possible to easily replace the expendable sealing elements (V-rings 501, 502, slip ring 503, ribs 202) by unjoining first and second casings 301 and 302 when maintenance of toner supply device 100 is needed. This means improvement in maintenance of toner supply device 100.

In general, in order to avoid toner leakage and other defects, bottle holder 300 and toner bottle 200 need to be formed with dimensional accuracy, particularly in the supported portion of toner bottle 200 by bottle holder 300.

However, since toner bottle 200 is usually formed by blow molding, the toner bottles are prone to include variations in size when they are molded. Similarly, bottle holder 300 is also formed by blow molding, so that the bottle holders are prone to include variations in size when they are molded.

In the above embodiment, since V-ring 502 is made to provide sealing function by pressing its sealing flange 502*a* into contact with inner peripheral surface 300*e* of bottle holder 300 as described above, it is possible to absorb the size variations of bottle holder 300 and toner bottle 200 originating from molding, in the clearance between toner bottle 200 and bottle holder 300, or more clearly, in the space formed between the surface of main part 201 of toner bottle 200 and bottle holder 300.

Next, shutter mechanism 400 will be described with reference to the drawings.

Figure 27A:
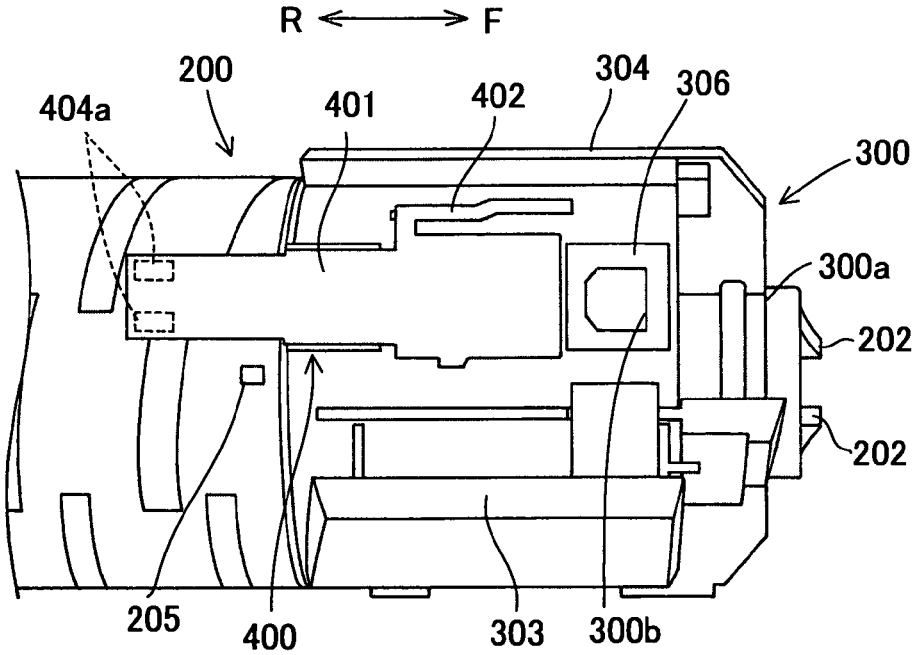
FIG. 27A is an illustrative view showing the bottle holder with its toner discharge port open.
Figure 27B:
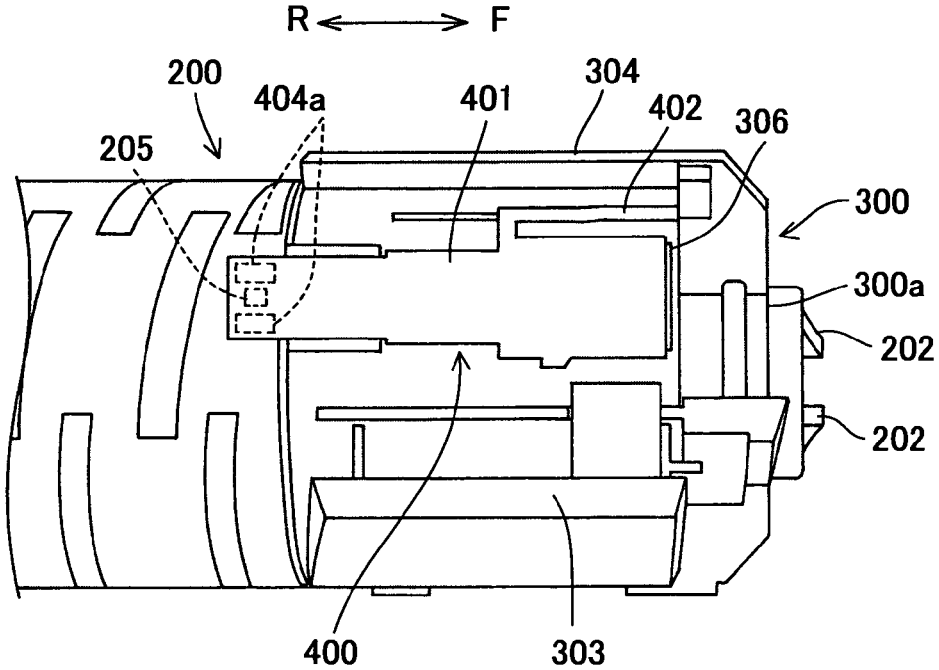
FIG. 27B is an illustrative view showing the bottle holder with the toner discharge port closed by a shutter mechanism.
Figure 28:
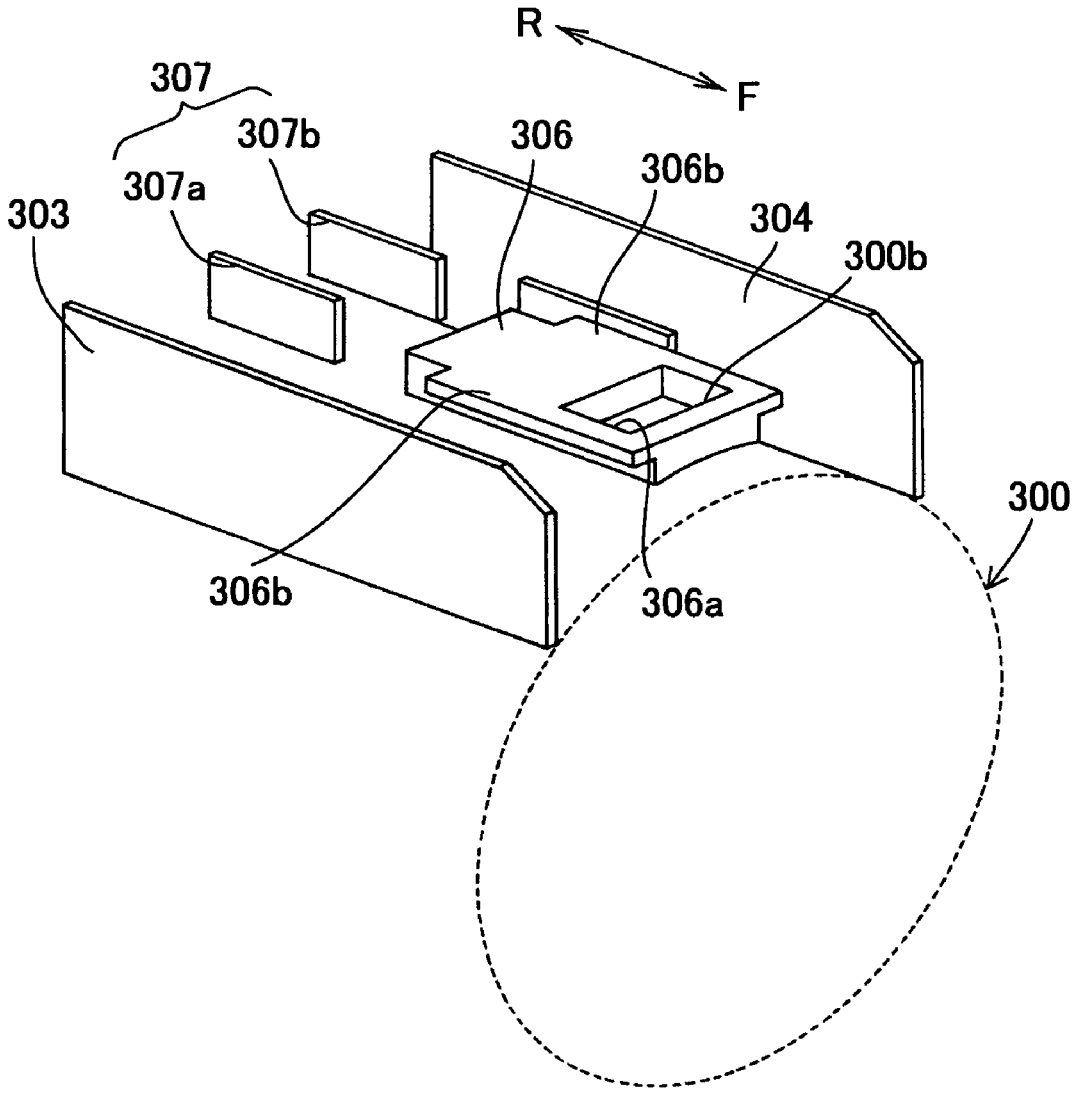
FIG. 28 is an illustrative view showing the schematic structure of the rear side of the bottle holder.

FIG. 27A is an illustrative view showing the bottle holder with its toner discharge port open, FIG. 27B is an illustrative view showing the bottle holder with the toner discharge port closed by a shutter mechanism, and FIG. 28 is an illustrative view showing the schematic structure of the rear side of the bottle holder.

As shown in FIGS. 27A and 27B, shutter mechanism 400 has a plate-like shutter member 401 that is slidable in the directions of arrows F and R, in the bottom of bottle holder 300. In the present embodiment, the side on which ribs 202, 202 of toner bottle 200 are projected from opening 300*a* at the front end of bottle holder 300 is called the front (F) side and the opposite is called the rear (R) side.

In shutter mechanism 400, as shutter member 401 slides in the direction of arrow. R, toner discharge port 300*b* of bottle holder 300 is opened, as shown in FIG. 27A. When shutter member 401 slides in the direction of arrow F, toner discharge port 300*b* of bottle holder 300 is closed, as shown in FIG. 27B.

As shown in FIG. 28, bottle holder 300 is formed with first and second guide members 306 and 307 for guiding shutter member 401.

First guide member 306 is a flat plate-like member essentially parallel to the bottom surface of bottle holder 300 and is formed with an opening 306*a* that communicates with toner discharge port 300*b* of the bottle holder 300. Further, the side edge portions 306*b*, 306*b*, of first guide member 306, located at both sides with respect to the directions of arrows F and R, are formed to be thin with the attachment side to bottle holder 300 indented at both sides. These side edge portions 306*b*, 306*b* will function as guide rails for shutter member 401.

On the other hand, second guide member 307 consists of two guide plates 307*a* and 307*b* with their plate surfaces opposing each other, which are extended in the direction of arrow. R on the downstream side, with respect to the direction of arrow R, of the attachment position of first guide member 306. These guide plates 307*a* and 307*b* will function as guide rails for shutter member 401.

Now, shutter member 401 will be described with reference to the drawings.

Figure 29A:
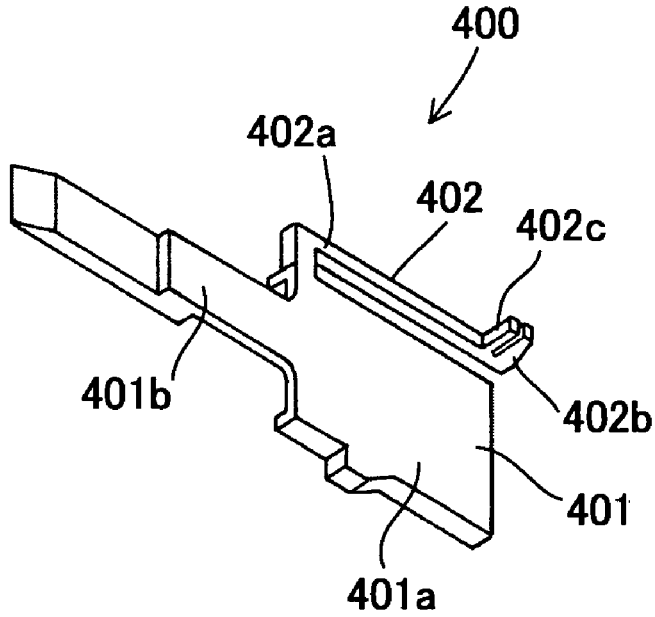
FIG. 29A is a perspective view showing the configuration of a shutter mechanism for a toner supply device in accordance with the present embodiment, when viewed from the front side.
Figure 29B:
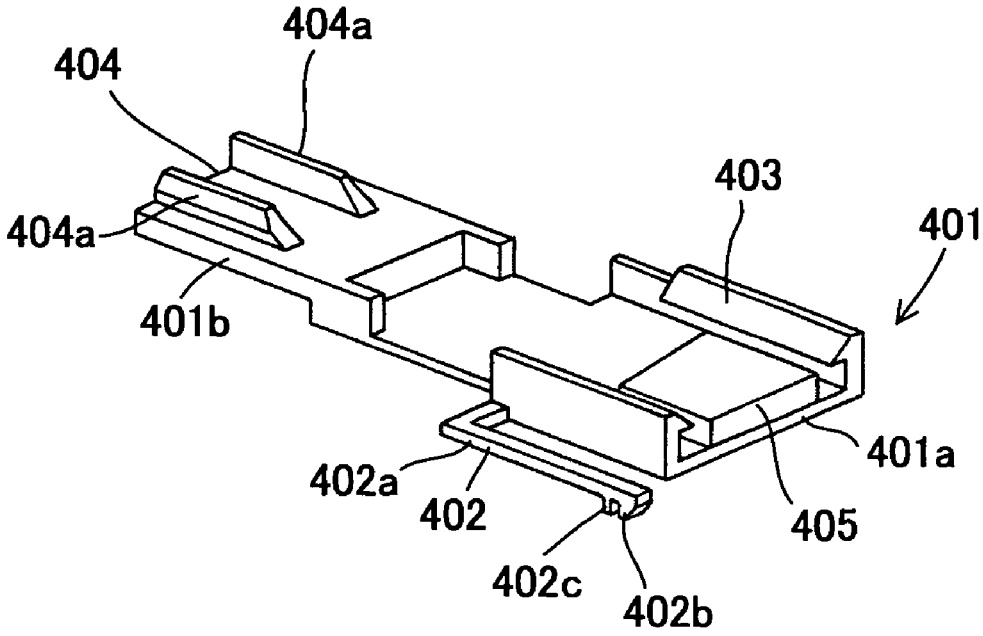
FIG. 29B is a perspective view showing the shutter mechanism when viewed from the rear side.
Figure 30A:
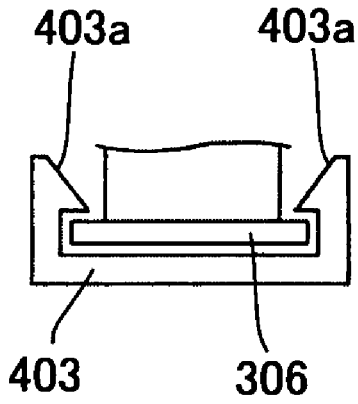
FIG. 30A is an illustrative view showing the relationship between the shutter mechanism and a first guide member of the bottle holder.
Figure 30B:
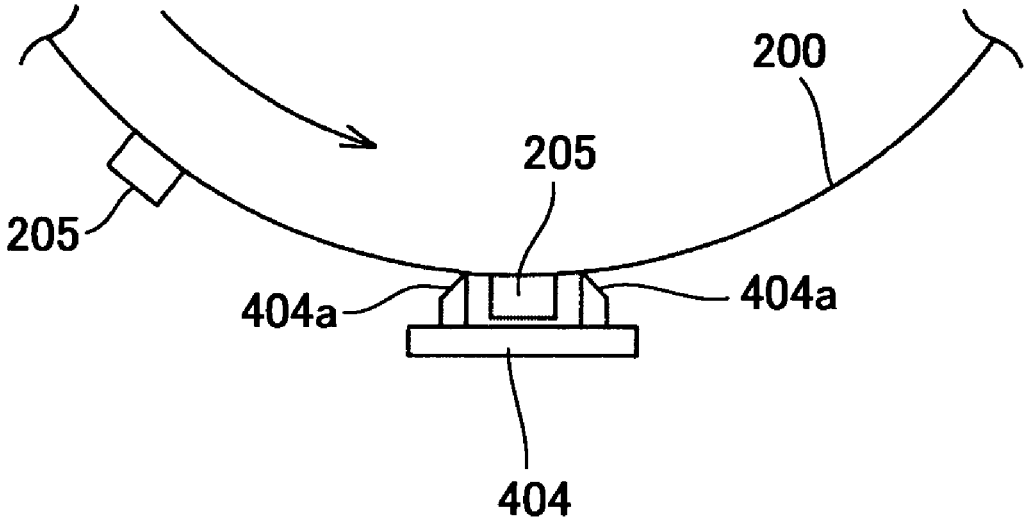
FIG. 30B is an illustrative view showing the relationship between the shutter mechanism and the rotation of the toner bottle.

FIG. 29A is a perspective view, viewed from the front side, showing the configuration of the shutter mechanism for the toner supply device in accordance with the present embodiment, FIG. 29B is a perspective view showing the shutter mechanism when viewed from the rear side, FIG. 30A is an illustrative view showing the relationship between the shutter mechanism and the first guide member of the bottle holder, and FIG. 30B is an illustrative view showing the relationship between the shutter mechanism and the rotation of the toner bottle.

Shutter member 401 is made of plate-like resin, and is composed of a shutter part 401*a* for actually covering the opening and a guide part 401*b* extended from the shutter part 401*a*.

As shown in FIG. 29A, shutter part 401*a* is formed with a regulating member 402 for limiting movement in shutter member 401. This regulating member 402 is composed of an essentially L-shaped main piece 402*a* connected at its one end to shutter part 401*a* and first and second hooks 402*b* and 402*c* formed in the end opposite to the connected side with shutter part 401*a* of main piece 402*a*.

A gap of a predetermined distance is formed between first and second hooks 402*b* and 402*c*. The gap distance is determined such that the front end of second hook 402*c* touches first hook 402*b* when the former falls down towards the latter.

On the undersurface of shutter part 401*a*, a first slider 403 that slidably holds first guide member 306 (FIG. 28) having toner discharge port 300*b* of the aforementioned bottle holder 300 is formed extending in the longitudinal direction of shutter member 401, as shown in FIG. 29B. That is, as shown in FIG. 30A, first slider 403 slidably holds first guide member 306 by means of a pair of hooks 403*a*, 403*a* arranged at both sides.

On the underside of guide part 401*b*, a second slider 404 that is slidably supported by guide plates 307*a* and 307*b* of second guide member 307 is formed extending in the longitudinal direction of shutter member 401, as shown in FIG. 29B. Second slider 404 has a pair of slide plates 404*a*, 404*a* to be guided by guide plates 307*a*, 307*a* of second guide member 307.

Further, formed on the rear side (FIG. 29B) of shutter part 401*a* is a spongy Mylar seal 405 for hermetically sealing toner discharge port 300*b* of bottle holder 300. The size of Mylar seal 405 is not particularly limited as long as it can hermetically seal the toner discharge port 300*b* when shutter part 401*a* of shutter member 401 covers toner discharge port 300*b*.

Concerning slide plates 404*a*, 404*a* (FIG. 29B) of second slider 404, when shutter member 401 has moved to the arrow-F side (FIG. 28), or when opening 300*a* of bottle holder 300 is closed, projecting piece 205 (FIGS. 27A and 27B) formed on the toner bottle 200 surface fits between slide plates 404*a*, 404*a* as shown in FIG. 30B to thereby restrain the toner bottle 200 from rotating. When shutter member 401 is moved in the direction of arrow R, slide plates 404*a*, 404*a* also move in the direction of arrow R to thereby cancel the engagement with projecting piece 205 (FIG. 27A).

This movement cancels restraint on toner bottle 200's rotation. That is, when toner discharge port 300*b* of bottle holder 300 is released so that toner supply device 100 makes a toner supply operation, rotation of toner bottle 200 will not be hindered.

Next, toner supply assembly mounting mechanism 600 will be described with reference to the drawings.

Figure 31:
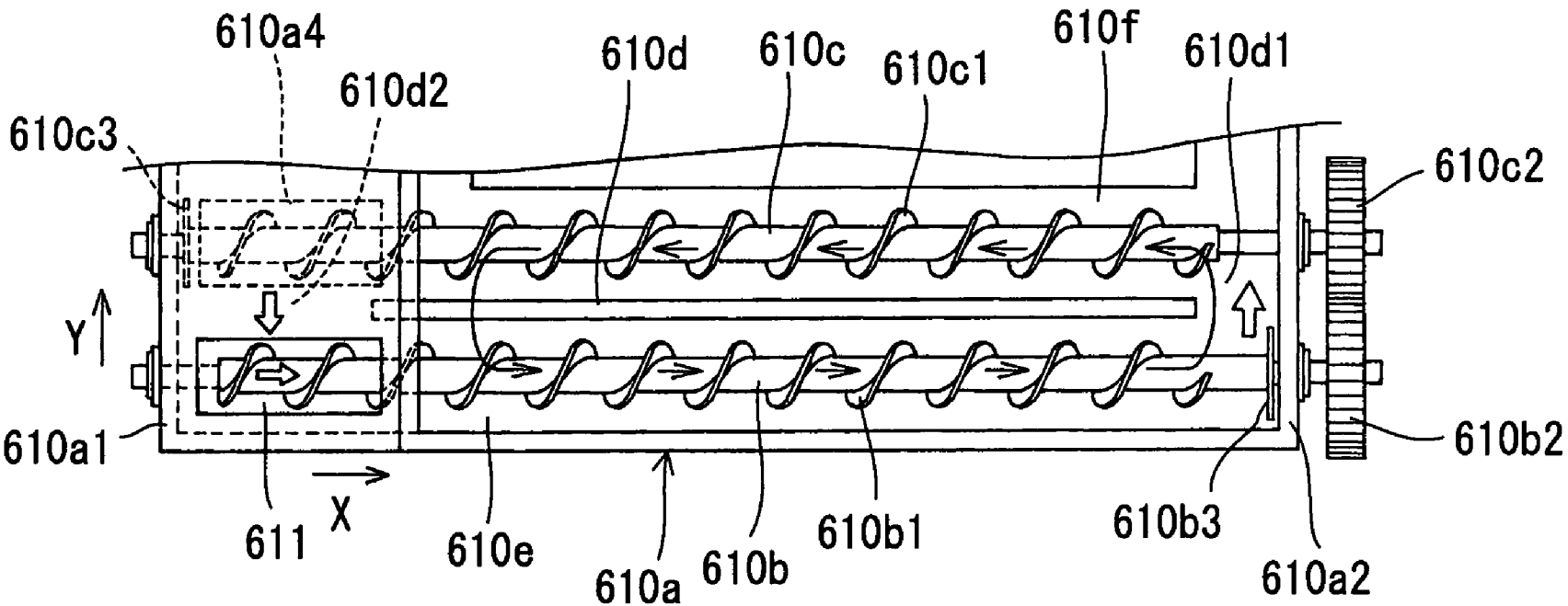
FIG. 31 is an illustrative view showing the structure of the toner supply assembly mounting mechanism.
Figure 32:
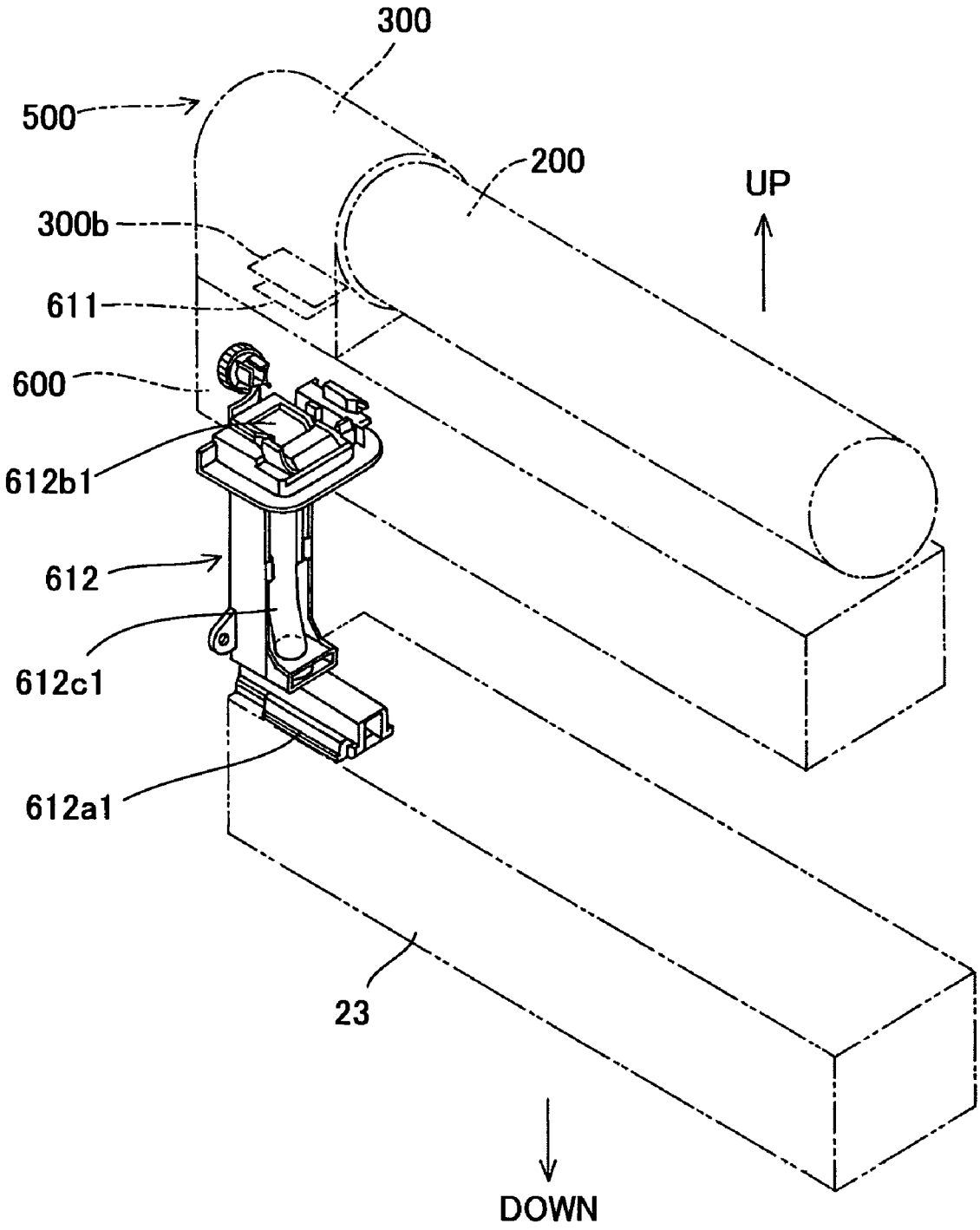
FIG. 32 is an illustrative view showing the structure of a supply passage part for coupling the toner supply assembly mounting mechanism with a developing unit.

FIG. 31 is an illustrative view showing the structure of a toner supply assembly mounting mechanism as a part of a toner supply device according to the present embodiment, and FIG. 32 is an illustrative view showing the structure of a supply passage part for coupling the toner supply assembly mounting mechanism with a developing unit.

As shown in FIGS. 1, 2, 5 and 6, toner supply assembly mounting mechanism 600 is constructed such that toner supply assembly 500 is disposed essentially parallel to, and opposing, developing unit 23 with transfer belt unit 30 disposed therebetween. Toner supply assembly mounting mechanism 600 is constructed so that two toner supply assemblies 500*a* for storing black toner can be mounted together.

In toner supply assembly mounting mechanisms 600, mount bases 602 (602*a*, 602*b*, 602*c* and 602*d*: FIGS. 5 and 6) onto which toner supply assemblies 500 are mounted are formed lengthwise in the direction (the transfer belt width direction) approximately perpendicular to the transfer belt's direction of conveyance.

As shown in FIG. 5, toner supply assemblies 500 are fixed to corresponding drive mechanisms 701 (701*a*, 701*b*, 701*c* and 701*d*), respectively, on the bottle holder 300 side while toner bottles 200 are fixed by holding belts 702 on the opposite side.

Provided for each drive mechanism 701 is an actuator (not shown) which, when toner supply assembly 500 is mounted to mount base 602, transfers driving force (rotational force) to the bottle by coupling itself with toner bottle 200's ribs 202 (FIG. 7) that are projected from opening 300*a* of the aforementioned bottle holder 300. Usually, the actuator is composed of a motor, and is controlled to drive in accordance with the condition of toner being supplied.

On the other hand, holding belt 702 (FIG. 5) is adapted to hold toner bottle 200 of the toner supply assembly 500 when toner supply assembly 500 is mounted to mount base 602, and is removably attached to mount base 602. Holding belt 702 is attached to mount base 602 to hold toner bottle 200, leaving a clearance so that the toner bottle 200 is rotatable or touching the toner bottle 200 with such friction as to allow the bottle to rotate.

In toner supply assembly mounting mechanism 600, the mount base 602 on which toner supply assembly 500 is to be mounted, has a toner feed port 611 (611*a*, 611*b*, 611*c* or 611*d*) on the upper surface thereof as shown in FIG. 6. This toner feed port is disposed at one end side on the upper surface where bottle holder 300 of toner supply assembly 500 is mounted, correspondingly to shutter mechanism 400 for the bottle holder 300. On the underside of the mount base, supply passage part 612 (612*a*, 612*b*, 612*c* or 612*d*) for toner conveyance is provided to establish communication between the toner supply port 611 and developing unit 23 that is arranged under toner supply assembly mounting mechanism 600.

Here in FIG. 6, for description convenience, mount base 602*a* corresponding to toner supply assembly 500*a* of black toner is partially omitted.

Supply passage part 612*a* provided in mount base 602*a* for toner supply assembly 500*a* for black toner (FIG. 1) has two toner feed ports 611*a*, 611*a* corresponding to two toner supply assemblies 500*a*. That is, this supply passage part is constructed so as to receive toner fed from the two ports and feed the toner to single developing unit 23*a* for black toner through toner input port 234*a* (FIGS. 2 and 3) formed in developing unit 23*a*.

Each toner supply assembly mounting mechanism 600 is constructed as shown in FIGS. 3 and 31 such that toner fed from toner supply assembly 500 is delivered from toner feed port 611 that is disposed outside the area of the transfer belt with respect to the direction perpendicular to the transfer belt's direction of conveyance, or in short, outside the width W of the transfer belt.

On the other hand, each of mount bases 602*b* to 602*d* of toner supply assemblies 500*b* to 500*d* for cyan, magenta and yellow toners is formed with a casing 610*a* (FIG. 31) that has a box shape elongated in the width direction of the transfer belt. The casing 610*a* incorporates a first toner agitator shaft (toner conveyor means) 610*b* and a second toner agitator shaft (toner conveyor means) 610*c*, arranged parallel to each other along the axis direction of developing roller 231 (FIG. 2).

The interior of casing 610*a* is divided into a first toner chamber (toner reservoir) 610*e* with first toner agitator shaft 610*b* disposed therein and a second toner chamber (toner reservoir) 610*f* with second toner agitator shaft 610*c* disposed therein, by a partitioning element 610*d*.

First and second toner agitator shafts 610*b* and 610*c* have screws 610*b*1 and 610*c*1 for agitating and conveying toner, respectively, and are driven by an unillustrated drive motor by way of drive gears 610*b*2 and 610*c*2 arranged on the other side 610*a*2 of casing 610*a*.

Toner support plates 610*b*3 and 610*c*3 are provided for first and second toner agitator shafts 610*b* and 610*c*, respectively, at their downstream side ends with respect to the direction of toner conveyance so as to receive the toner being conveyed.

Here, the toner agitating means should not be limited to screws 610*b*1 and 610*c*1, but it may be a structure in which a multiple number of agitating vanes tilted with the direction of toner conveyance are formed on the first and second toner agitator shafts 610*b* and 610*c*, for example. Also any other configuration can be used as long as it can achieve the same effect.

Partitioning element 610*d* is formed in casing 610*a* along the casing length or along the first and second agitator shafts 610*b* and 610*c*, having toner chamber communication ports 610*d*1 and 610*d*2 formed near both side walls of casing 610*a* to allow for toner passage between first and second toner chambers 610*e* and 610*f*. These toner chamber communication ports 610*d*1 and 610*d*2 permit toner to circulate from first toner chamber 610*e* to second toner chamber 610*f* and from second toner chamber 610*f* to first toner chamber 610*e*.

On the first end side, designated at 610*a*1, of casing 610*a*, a toner feed port 611 for receiving toner supply from toner bottle 200 arranged on the top thereof is formed while a toner feed port 610*a*4 for delivering the toner from casing 610*a* to supply passage part 612 that feeds toner to developing unit 23 arranged below is formed.

The opening of toner feed port 611 is formed at a position opposing part of first toner agitator shaft 610*b* for agitating and conveying toner from first end side 610*a*1 to second end side 610*a*2 of casing 610*a*.

On the other hand, the opening of toner feed port 610*a*4 is formed at a position opposing part of second toner agitator shaft 610*c* for agitating and circulatively conveying toner from second end side 610*a*2 to first end side 610*a*1 of casing 610*a*.

Each supply passage part 612 is formed so that its top is integrated with toner supply assembly mounting mechanism 600, and a developing unit attachment portion 612*a* for detachable attachment to developing unit 23 is provided at the bottom thereof, as shown in FIG. 32.

An opening of a toner input port 612*b*1 for toner input is formed at the top of supply passage part 612, and a toner passage 612*c*1 for toner to pass from this toner input port 612*b*1 to developing unit attachment portion 612*a* is provided approximately linearly from top to bottom.

Further, as shown in FIG. 6, at one end side on the top of casing 610*a* of mount base 602, bottle holder guide portions 620, 620 that engage portions 303*c* and 304*c* (FIG. 7B) of first and second fixing structures 303 and 304 and guide them are projectively formed at the positions opposing first and second fixing structures 303 and 304 (FIG. 7B) of bottle holder 300 when toner supply assembly 500 has been mounted. Bottle holder guide portions 620, 620 are arranged essentially parallel to each other with toner feed port 611 positioned therebetween and extended in the longitudinal direction of mount base 602.

Toner feed port 611 of mount base 602 is formed at the position corresponding to shutter member 401 (FIG. 27A) of shutter mechanism 400 provided for bottle holder 300 when toner supply assembly 500 is mounted. In other words, toner feed port 611 is formed at a position so as to be able to receive toner discharged from toner discharge port 300*b* when the toner discharge port 300*b* of bottle holder 300 is released by shutter mechanism 400.

Formed in the vicinity of toner feed port 611 is a projection piece 613 (613*a*, 613*b*, 613*c* or 613*d*: FIG. 6), which is hooked by a hooking portion (described later) of regulating member 402 (FIGS. 27A and 29A) provided for shutter member 401 of shutter mechanism 400 to limit the movement of shutter member 401.

On the side longitudinally opposite to toner feed port 611 of mount base 602, a supporter 614 (614*a*, 614*b*, 614*c* or 164*d*) for supporting the rear end (the end on the side opposite to the mounted portion of bottle holder 300) of toner bottle 200 when toner supply device 100 is mounted is formed.

This supporter 614 is to create a predetermined clearance between toner bottle 200 and mount base 602 and functions to smoothen the rotation of toner bottle 200. Here, the configuration and the like of supporter 614 is not particularly limited; any configuration and material can be used as long as toner bottle 200 can rotate smoothly.

The forming position of projection piece 613 provided near toner feed port 611 is determined by the regulatory operation of regulating member 402.

Next, how the forming position of projection piece 613 is determined will be described with reference to the drawings.

Figure 33A:
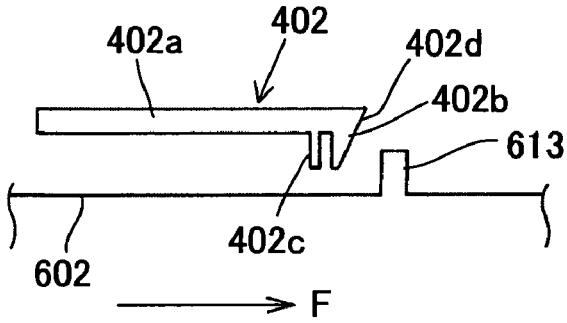
FIG. 33A is an illustrative view showing the positional relationship between a regulating member and a projection piece before the toner supply device is mounted to a mount base.
Figure 33B:
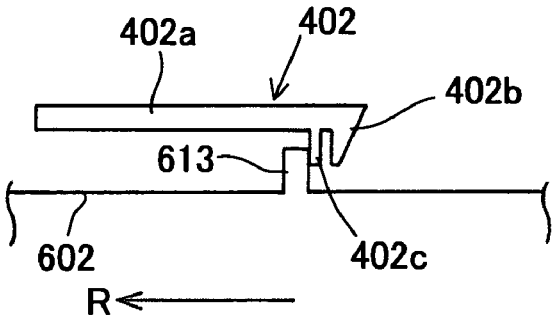
FIG. 33B is an illustrative view showing the positional relationship between the regulating member and the projection piece when the toner supply device has been mounted to the mount base.
Figure 33C:
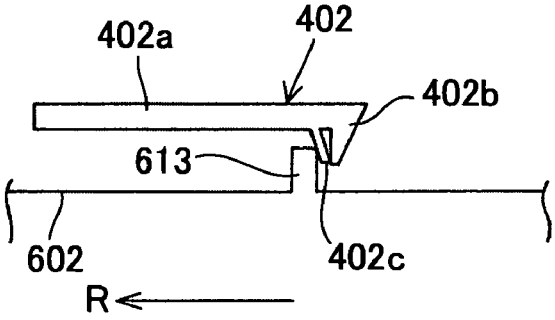
FIG. 33C is an illustrative view showing the positional relationship between the regulating member and the projection piece when the toner supply device is dismounted from the mount base.

FIG. 33A is an illustrative view showing the positional relationship between the regulating member and the projection piece before the toner supply device according to the present embodiment is mounted to the mount base; FIG. 33B is an illustrative view showing the positional relationship between the regulating member and the projection piece when the toner supply device has been mounted to the mount base; and FIG. 33C is an illustrative view showing the positional relationship between the regulating member and the projection piece when the toner supply device is dismounted from the mount base.

Projection piece 613 is formed at such a position that shutter member 401 will open toner discharge port 300*b* of bottle holder 300 by its engagement with regulating member 402 when toner supply device 100 has been completely attached to mount base 602 and will close toner discharge port 300*b* of bottle holder 300 when toner supply device 100 is removed from mount base 602.

Regulating member 402 has first hook 402*b* and second hook 402*c* formed at the front end (on the side of engagement with projection piece 613) of main piece 402*a*, as already mentioned.

First hook 402*b* is disposed at a position more front than second hook 402*c* and its abutment surface 402*d* against projection piece 613 is formed beveled so that it can easily ride over the projection piece 613. Here, abutment surface 402*d* is so inclined that its contact area with the top of projection piece 613 is minimized.

When abutment surface 402*d* of first hook 402*b* is inclined in this way, regulating member 402 is moved in the direction of arrow F from the state shown in FIG. 33A, and first hook 402*b* rides over projection 613 formed on first casing 301. With a further movement of the regulating member in the direction of arrow F, second hook 402*c* also rides over projection 613. From this state, when regulating member 402 is caused to move in the direction opposite to the direction of arrow F, movement of regulating member 402 is obstructed by projection piece 613 and second hook 402*c* (the state shown in FIG. 33B).

Next, how toner supply device 100 is mounted to the image forming apparatus will be described.

Toner supply device 100 is adapted to be mounted to toner supply assembly mounting mechanism 600 by sliding bottle holder 300 side of toner supply assembly 500 over and along mount base 602 of toner supply assembly mounting mechanism 600.

By this sliding movement of toner supply assembly 500, shutter member 401 of shutter mechanism 400, provided for bottle holder 300, opens or closes toner discharge port 300*b* of the bottle holder 300, as shown in FIGS. 33A, 33B and 33C.

Movement of shutter member 401 is controlled by regulating member 402 that is integrally formed with shutter member 401.

In the case where toner discharge port 300*b* of bottle holder 300 is opened by shutter mechanism 400, as shutter member 401 moves in the direction of arrow R, regulating member 402 moves and takes the state shown in FIG. 33B. Then, with a further movement in the direction of arrow R, second hook 402*c* abuts projection piece 613 and falls down to the first hook 402*b* side, as shown in FIG. 33C, so that the first hook 402*b* together with second hook 402*c* ride over projection piece 613 as the movement in the direction of arrow. R continues. In this way, toner discharge port 300*b* of bottle holder 300 is released.

In the case where toner supply assembly 500 is dismounted from toner supply assembly mounting mechanism 600, as toner supply assembly 500 is pulled out from toner supply assembly mounting mechanism 600, the aforementioned actions take place in the reverse order, that is, shutter member 401 moves in the direction of arrow F (FIG. 33A) so that toner discharge port 300*b* of bottle holder 300 is closed.

Next, the operation of bottle cap 260 (FIGS. 17 to 20) of toner bottle 200 according to the present embodiment will be described.

When the toner in toner bottle 200 set in image forming apparatus 1 has been used up, it is necessary to replace the toner bottle 200 with a new one. The toner bottle 200 with its toner used up is adapted to be able to be recycled by loading toner into it.

Specifically, according to toner bottle 200 of the present embodiment, it is possible to simply reuse the toner bottle by removing bottle cap 260 from toner loading portion 230 and loading toner into the bottle from toner loading portion 230.

When toner bottle 200 is full of toner and ready for use, bottle cap 260 fastened by screw-fitting on toner loading portion 230 is in locked by the engagement between locking projection 280 of bottle cap 260 and cap locking projection 250 of toner loading portion 230.

As shown in FIGS. 19A and 19B, the locked state of bottle cap 260 is established by abutment between second slope 280*b* of locking projection 280 and second slope 250*b* of cap locking projection 250 in toner loading portion 230 and abutment between a first slope 270*a* of threaded portion 270 and first slope 250*a* of cap locking projection 250.

To remove bottle cap 260 from toner loading portion 230 by releasing this locked state of bottle cap 260, bottle cap 260 is turned in the loosening direction (in the direction indicated by arrow 260S2 in the drawing). Then, bottle cap 260, as being slightly deformed, causes locking projection 280 to move up along second slope 250*b* of cap locking projection 250 to the top and ride over cap locking projection 250, thus releasing the locked state.

Then, bottle cap 260 is removed from main part 201 and toner is loaded from toner loading opening 230*a*. After the bottle has been filled with toner, bottle cap 260 is screw-fitted and fastened again to main part 201 to complete the toner loading operation.

When bottle cap 260 is fastened by screw-fitting to toner loading portion 230, bottle cap 260 is turned in a fastening direction (in the direction of arrow 260S1 in the drawing) until locking projection 280 abuts cap locking projection 250.

Then, the bottle cap is further turned so that locking projection 280 moves up along first slope 250*a* of cap locking projection 250 to the top and rides over cap locking projection 250 to thereby establish the locked state.

In this condition, toner loading opening 230*a* is hermetically closed by bottle cap 260.

According to the present embodiment, the inclination angle θa of first slope 250*a* of cap locking projection 250 is formed to be more acute than the inclination angle θb of second slope 250*b*, that is, the first slope is formed to be more gentle than second slope 250*b*. Hence, bottle cap 260 can be operated with a weaker force when it is set into the locked state than when it is released from the locked state, and bottle cap 260 is hard to loose even if it is wrongly operated, it is possible to handle the toner bottle 200 in safety.

Next, loading of toner into toner bottle 200 according to the present embodiment will be described with reference to the drawings.

Figure 34:
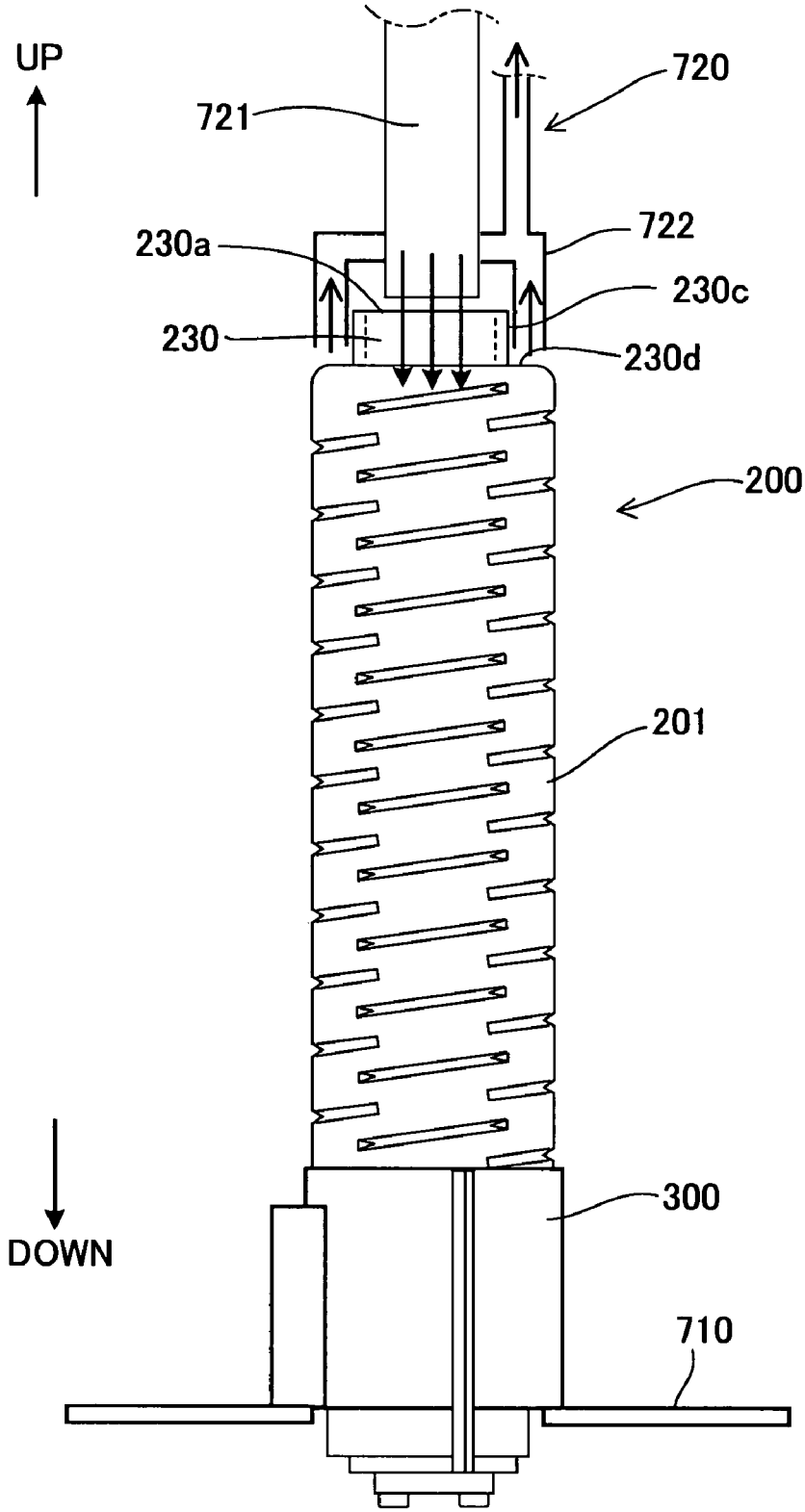
FIG. 34 is an illustrative view showing a schematic configuration of a device for loading toner into the toner bottle; and, FIG. 35 is an illustrative view showing an overall configuration of a copier according to another embodiment.

FIG. 34 is an illustrative view showing a schematic configuration of a device for loading toner into the toner bottle according to the present embodiment.

When toner bottle 200 is loaded (refilled) with toner, toner bottle 200 is set on a toner feeder base 710 approximately upright with toner loading portion 230 up, and a toner feeder 720 from an unillustrated toner loading machine is set to toner loading portion 230.

Toner feeder 720 includes a toner loading nozzle 721 for loading toner into main part 201 of toner bottle 200 and a suctioning portion 722 for suctioning air around proximal part 230*d* of toner loading portion 230.

Toner loading nozzle 721 is adapted to load toner as being positioned so as to oppose toner loading opening 230*a* from above or so as to be inserted into main part 201 from toner loading opening 230*a*.

Suctioning portion 722 is arranged to enclose outer periphery 230*c* of toner loading portion 230 and suction air around proximal part 230*d* of toner loading portion 230 along the outer periphery thereof.

Loading of toner into toner bottle 200 by toner feeder 720 is performed by feeding toner into main part 201 from toner loading nozzle 721 while suctioning and cleaning spilt or scattered toner in the atmosphere around toner loading port 230 by suctioning portion 722.

Since, in the above way, the step of toner loading and the step of air suctioning around toner loading portion 230 are executed in parallel, it is possible to perform a toner loading operation in a short period and hence it is possible to not only improve work efficiency but also present a beneficial apparatus and work environments without contaminating the operator and apparatus atmosphere with flooded toner from toner loading opening 230*a*.

According to the present embodiment thus constructed, use of toner bottle 200 makes it possible to refill the bottle with toner by simply removing bottle cap 260 after toner is used up, and it is possible to attach the bottle cap 260 in a reliable manner. This enables easy recycling of toner bottle 200.

Also, according to the present embodiment as shown in FIGS. 5 and 7A, the embedment of IC chip 261 into bottle cap 260 of toner bottle 200 facilitates confirmation of the information on recycling of toner bottle 200.

Though, in the present embodiment, IC chip 261 is embedded in bottle cap 260, the present technology should not be limited to this. For example, an IC chip may be fitted to main part 201.

Further, in the present embodiment, locking projection 280 is formed on the extension of threaded portion 270 of bottle cap 260 and cap locking projection 250 is formed at a position, on toner loading projection 230, corresponding to the threaded portion 270. However, the present technology is not limited by the arrangement of locking projections. For example, locking projections may be formed respectively at positions on the peripheral edges of bottle cap 260 and proximal portion 230*d* of toner loading portion 230 when toner loading opening 230*a* is hermetically closed by bottle cap 260. The shapes of the locking projections are also not limited to those of cap locking projection 250 and locking projection 280 of the present embodiment.

Moreover, though the present embodiment has been described taking an example in which toner supply device 100 using toner bottle 200 is applied to the image forming apparatus 1 shown in FIG. 1, the present technology should not be limited to the above and can be applied to any kinds of image forming apparatuses as long as they use an exchangeable toner container. For example, the technology may be applied to a copier 101 shown in FIG. 35.

Figure 35:
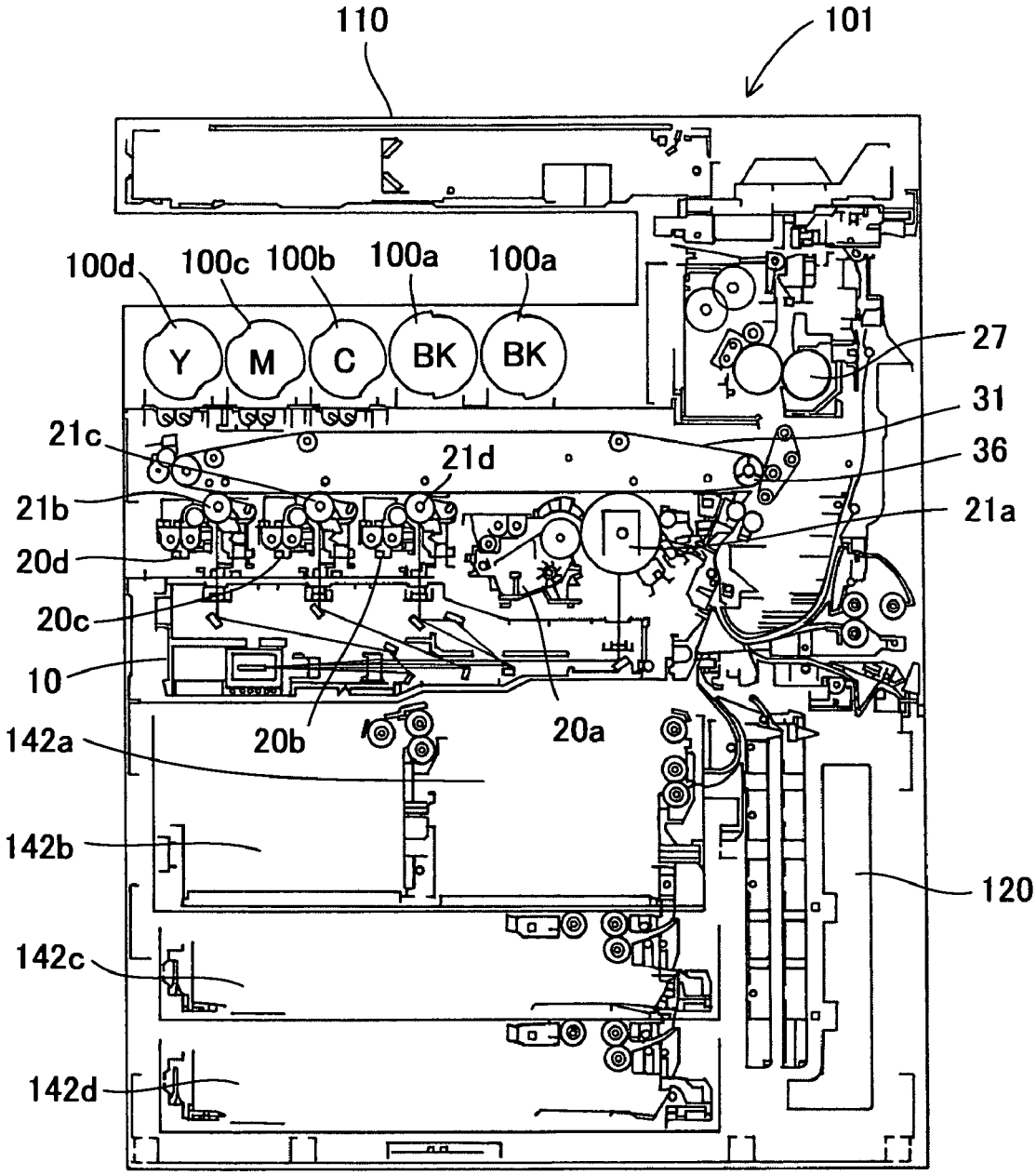

As shown in FIG. 35, copier 101 includes an image reader (scanner) 110 disposed above an image forming portion 108 using toner bottle 200 and having almost the same configuration as that of image forming apparatus 1 according to the embodiment described above, and first, second, third and fourth paper feed cassettes 142*a*, 142*b*, 142*c* and 142*d* disposed under image forming portion 108 for supporting multiple kinds of paper, to thereby facilitate a variety of and a large amount of automatic printing. In the drawing, a reference numeral 120 designates a waste toner box for collecting waste toner.

Here, in copier 101, the same components as those in image forming apparatus 1 of the aforementioned embodiment will be allotted with the same reference numerals and description is omitted.

Further, the present technology can be developed into any form of other kinds of image forming apparatuses etc., not limited to the image forming apparatus and copier having the above configurations, as long as it is an image forming apparatus having a structure that permits refill of a supply material with an exchangeable supply container.

As has been described above, the present technology should not be limited to the above embodiment and example and various changes can be made within the range specified in the scope of claims. That is, any embodied mode obtained by combination of technical means modified as appropriate without departing from the spirit and scope of the present technology should be included in the scope of the technology, as set forth in the following claims.

What is claimed is:

1. A toner container comprising:

a cylindrical toner storing portion to be filled with toner;

a toner loading portion formed at a first end of the toner container and having a toner loading opening from which toner is loaded into the toner storing portion;

a cap element which is able to hermetically close and open the toner loading opening;

a toner discharge port for discharging the toner stored in the toner storing portion out of the container, wherein the toner discharge port is formed on a second end that is opposite to the first end where the toner loading portion of the toner container is formed, the toner discharge port being formed on an end wall of the cylindrical toner storing portion that is oriented substantially perpendicular to a central longitudinal axis of the cylindrical toner storing portion, and wherein the toner discharge port is sealed by a sealing element bonded from without; and a holder that encloses the outer periphery of the second end where the toner discharge port is formed and rotatably holds the toner container, wherein the holder, when it encloses the second end of the toner container, has an inner wall portion located opposing the toner discharge port, characterized in that:

the cap element is constructed so as to enclose the toner loading opening, wherein the cap element includes female threads so that the cap element can be fastened by screw-fitting to the toner loading portion, and wherein the cap element includes, as an engaging portion with the toner loading portion, a first projection capable of limiting the rotation of the cap element in a loosening direction, the first projection being located adjacent a terminal end of the female threads; and wherein the toner loading portion includes male threads that engage the female threads on the cap element, and wherein the toner loading portion includes, as an engaging portion with the cap element, a second projection engaging the first projection and capable of limiting the rotation of the cap element in the loosening direction, the second projection being located adjacent a beginning end of the male threads.

2. The toner container according to claim 1, wherein the engagement between the first projection and the second projection is designed so that a stronger rotational force is needed when the engagement between the first projection and the second projection is released by rotating the cap element relative to the toner loading portion in the loosening direction than when the first projection and the second projection become engaged by rotating the cap element relative to the toner loading portion in the fastening direction.

3. The toner container according to claim 1, further comprising an electric recording medium for storing information on the toner container, wherein the information can be read out in an image forming apparatus in which the toner container is set, and wherein the recording medium is mounted on the cap element.

4. The toner container according to claim 3, wherein the information stored on the recording medium includes ID information of the toner filled in the toner storing portion.

* * * * *